US007951216B2

(12) United States Patent
Ha et al.

(10) Patent No.: US 7,951,216 B2
(45) Date of Patent: May 31, 2011

(54) DUST SEPARATING APPARATUS OF VACUUM CLEANER

(75) Inventors: Gun-Ho Ha, Changwon (KR); Kyeong-Seon Jeong, Changwon (KR); Jin-Wook Seo, Changwon (KR); Kie-Tak Hyun, Changwon (KR); Chang-Ho Yun, Changwon (KR); Jin-Young Kim, Changwon (KR); Chang-Hoon Lee, Changwon (KR); Jin-Hyouk Shin, Changwon (KR); Seong-Koo Cho, Changwon (KR); Heon-Pyeong Ji, Changwon (KR); Geun-Bae Hwang, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/407,528

(22) Filed: Mar. 19, 2009

(65) Prior Publication Data

US 2009/0178376 A1 Jul. 16, 2009

Related U.S. Application Data

(63) Continuation of application No. PCT/KR2008/001454, filed on Mar. 14, 2008.

(30) Foreign Application Priority Data

| | | |
|---|---|---|
| Mar. 16, 2007 | (KR) | 10-2007-0026341 |
| Apr. 12, 2007 | (KR) | 10-2007-0036037 |
| Apr. 12, 2007 | (KR) | 10-2007-0036042 |
| Oct. 4, 2007 | (KR) | 10-2007-0099765 |
| Oct. 25, 2007 | (KR) | 10-2007-0107699 |

(51) Int. Cl.
*B01D 50/00* (2006.01)

(52) U.S. Cl. ..... 55/337; 55/322; 55/344; 55/348; 55/429; 55/424; 55/426; 55/DIG. 3; 55/419; 55/320; 15/352; 15/353

(58) Field of Classification Search ..... 55/337, 55/322, 344, 348, 429, 419, 320, 424, DIG. 3; 15/352, 353
See application file for complete search history.

(56) References Cited

U.S. PATENT DOCUMENTS

| | | | | |
|---|---|---|---|---|
| 447,333 | A | 3/1891 | Kutsche | |
| 3,505,703 | A | 4/1970 | Miller et al. | |
| 6,350,292 | B1 * | 2/2002 | Lee et al. | 55/459.1 |
| 6,436,160 | B1 | 8/2002 | Stephens et al. | |
| 6,572,668 | B1 * | 6/2003 | An et al. | 55/428 |
| 6,613,129 | B2 * | 9/2003 | Gen | 95/269 |
| 6,679,930 | B1 * | 1/2004 | An et al. | 55/337 |

(Continued)

FOREIGN PATENT DOCUMENTS

DE 10 2004 030 350 A1 1/2006

(Continued)

*Primary Examiner* — Jason M Greene
*Assistant Examiner* — Dung Bui
(74) *Attorney, Agent, or Firm* — Birch, Stewart, Kolasch & Birch, LLP

(57) ABSTRACT

The present exemplary embodiments relate to a dust separating apparatus for a vacuum cleaner. The dust separating apparatus for a vacuum cleaner according to present exemplary embodiments includes a cyclone in which a plurality of cyclone airflows is formed; a dust outlet for discharging dust separated by the plurality of cyclone airflows; and a dust container for storing dust discharged from the dust outlet, wherein the cyclone includes a body in which air flows along an inner surface thereof, and a pair of sides, each of the sides forming one of both side surfaces of the body and defining an outlet for discharging air.

23 Claims, 24 Drawing Sheets

U.S. PATENT DOCUMENTS

| | | | | |
|---|---|---|---|---|
| 6,810,558 | B2 * | 11/2004 | Lee | 15/353 |
| 7,419,521 | B2 * | 9/2008 | Oh et al. | 55/337 |
| 7,488,362 | B2 * | 2/2009 | Jeong et al. | 55/337 |
| 7,534,279 | B2 * | 5/2009 | Oh et al. | 55/343 |
| 7,628,833 | B2 * | 12/2009 | Oh | 55/345 |
| 7,686,861 | B2 * | 3/2010 | Oh | 55/429 |
| 2005/0229554 | A1 | 10/2005 | Oh et al. | |
| 2005/0252179 | A1 * | 11/2005 | Oh et al. | 55/337 |
| 2006/0107630 | A1 | 5/2006 | Ivarsson et al. | |
| 2006/0117725 | A1 * | 6/2006 | Oh et al. | 55/462 |
| 2007/0011997 | A1 | 1/2007 | Han et al. | |
| 2007/0079585 | A1 * | 4/2007 | Oh et al. | 55/345 |
| 2009/0056290 | A1 * | 3/2009 | Oh et al. | 55/337 |
| 2009/0293224 | A1 | 12/2009 | Hyun et al. | |
| 2010/0043170 | A1 * | 2/2010 | Ni | 15/352 |

FOREIGN PATENT DOCUMENTS

| | | | |
|---|---|---|---|
| DE | 20 2006 016 366 | U1 | 3/2007 |
| GB | 2 417 916 | A | 3/2006 |
| JP | 52-138367 | | 11/1977 |
| JP | 2003-139094 | A | 5/2003 |
| JP | 2004-135700 | A | 5/2004 |
| JP | 2004-174206 | A | 6/2004 |
| JP | 2005-040257 | A | 2/2005 |
| JP | 2005-324002 | A | 11/2005 |
| JP | 2005-342334 | A | 12/2005 |
| JP | 2006-130119 | A | 5/2006 |
| KR | 10-2000-0056656 | A | 9/2000 |
| KR | 2002-0078798 | A | 10/2002 |
| KR | 10-2005-0100913 | A | 10/2005 |
| KR | 10-2006-0030255 | A | 4/2006 |
| KR | 10-2006-0061493 | A | 6/2006 |
| KR | 10-0623916 | B1 | 9/2006 |
| KR | 10-2006-0105390 | A | 10/2006 |
| RU | 2240716 | C2 | 2/2000 |

* cited by examiner

DUST SEPARATING APPARATUS OF VACUUM CLEANER

CROSS-REFERENCE TO RELATED APPLICATIONS

This application is a continuation of International Patent Application No. PCT/KR2008/001454, filed Mar. 14, 2008, which claims priority to Korean Application No. 10-2007-0026341, filed Mar. 16, 2007, Korean Application No. 10-2007-0036037, filed Apr. 12, 2007, Korean Application No. 10-2007-0036042, filed Apr. 12, 2007, Korean Application No. 10-2007-0099765, filed Oct. 4, 2007, and Korean Application No. 10-2007-0107699, filed Oct. 25, 2007, all of which are herein incorporated by reference in their entireties.

BACKGROUND OF THE INVENTION

1. Field of the Invention

The present invention relates generally to a dust separating apparatus of a vacuum cleaner, and, more particularly, to a dust separating apparatus of a vacuum cleaner having a body including an air inlet formed in the body configured to receive an air flow containing dust, and a dust outlet formed to discharge dust separated in the body.

2. Description of Related Art

In general, a vacuum cleaner is an apparatus that uses suctioning force imparted by a suction motor installed in a main body to suction air including dust and filter the dust within the main body. Such vacuum cleaners can largely be divided into canister vacuum cleaners that have a suctioning nozzle provided separately from and connected with a main body, and upright vacuum cleaners that have a suctioning nozzle coupled to the main body.

A related art vacuum cleaner includes a vacuum cleaner main body, and a dust separator installed in the vacuum cleaner main body for separating dust from air. The dust separator is generally configured to separate dust using a cyclone principle. Because performance of this these vacuum cleaners can be rated based on the fluctuating range of their dust separating performance, dust separators for vacuum cleaners have continuously been developed to provide improved dust separating performance.

Also, from a user's perspective, dust separators for vacuum cleaners that can be easily separated from the vacuum cleaner main body, and that enable dust to easily be emptied, are desired.

BRIEF SUMMARY OF THE INVENTION

An object of the present invention is to provide a dust separator of a vacuum cleaner with improved dust separating performance.

Another object of the present invention is to provide a dust separator of a vacuum cleaner having a dust container with a simplified configuration to allow a user to easily empty dust.

A further object of the present invention is to provide a dust separator of a vacuum cleaner that allows a user to use minimal exertion to handle a dust container.

According to one aspect of the present invention, a dust separating apparatus for a vacuum cleaner is provided. The dust separating apparatus includes a cyclone configured to provide a plurality of cyclone airflows therein, the cyclone having a first air inlet configured to receive an airflow containing dust, a first air outlet located at a first side of the cyclone, and a dust outlet configured to discharge dust separated by the plurality of cyclone airflows. The dust separating apparatus also includes a dust container to collect dust discharged from the dust outlet.

In accordance with another aspect of the present invention, a dust separating apparatus including a cyclone configured to provide a plurality of cyclone airflows therein, the cyclone having a first air inlet configured to receive an airflow containing dust, a first air outlet, a dust outlet configured to discharge dust separated by the plurality of cyclone airflows, an opening, and a cover member for covering the opening, is provided. The dust separating apparatus also includes a dust container to collect dust discharged from the dust outlet, wherein opening the cover member exposes an interior of the cyclone without exposing an interior of the dust container.

In accordance with still another aspect of the present invention, a dust separating apparatus having a dust separator including a plurality of air inlets, a dust outlet that is less in number than the plurality of air inlets, the dust outlet configured to discharge dust separated from air suctioned through the plurality of air inlets is provided. The dust separating apparatus also includes a dust container to collect dust discharged through the dust outlet.

In accordance with another aspect of the present invention, a dust separating apparatus having a cyclone configured to provide a plurality of cyclone airflows therein, the cyclone having a first air inlet configured to receive an airflow containing dust, and a dust outlet configured to discharge dust separated by the plurality of cyclone airflows, is provided. The dust separating apparatus also includes a dust container to collect dust discharged through the dust outlet, wherein each of the cyclone airflows moves the dust in mutually convergent directions toward the dust outlet.

Further scope of applicability of the present application will become more apparent from the detailed description given hereinafter. However, it should be understood that the detailed description and specific examples, while indicating preferred exemplary embodiment embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Below, detailed descriptions of exemplary embodiment embodiments of the present invention will be provided with reference to the drawings.

Figure 1:
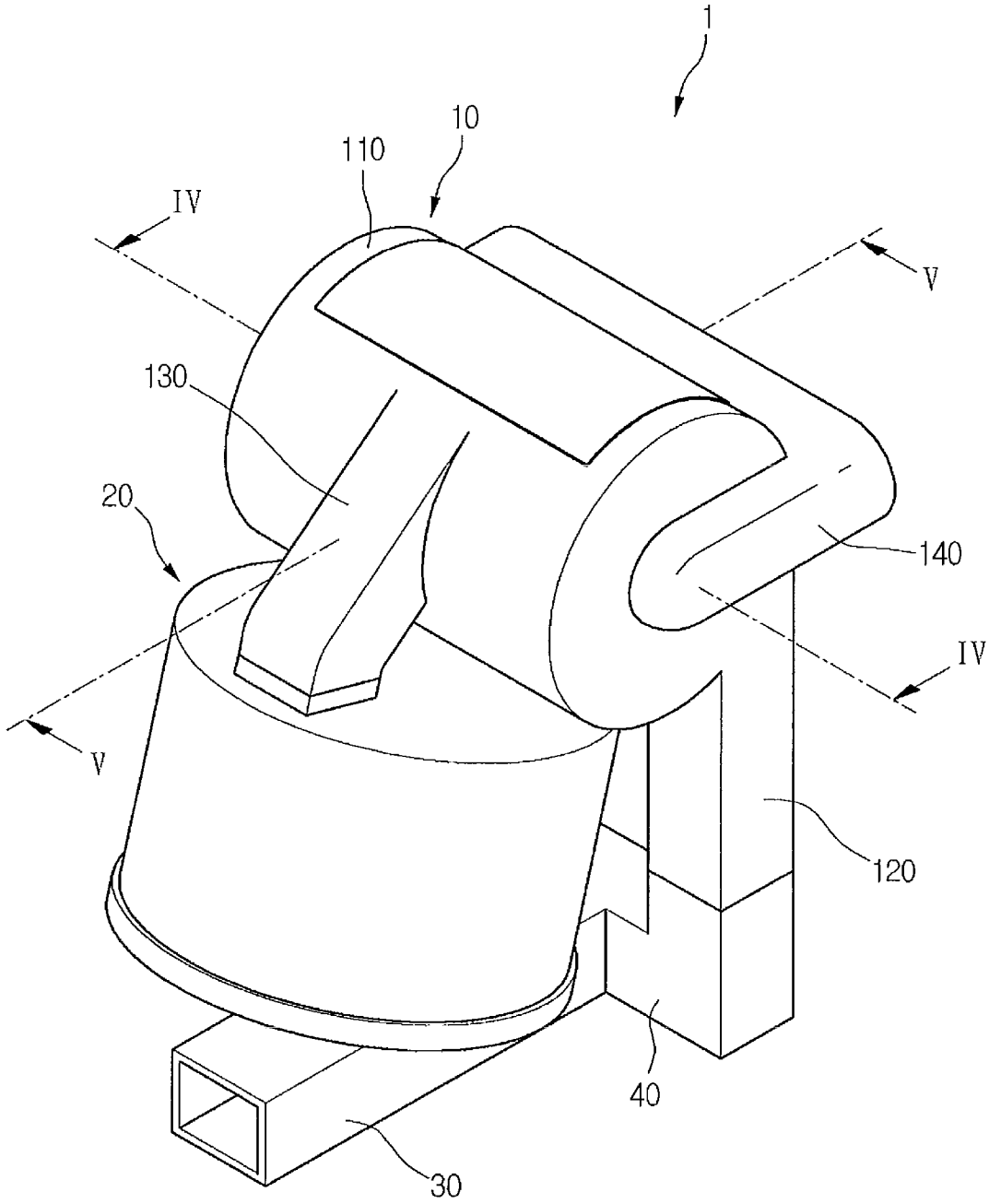
FIG. 1 is a front perspective view of a dust separating apparatus of a vacuum cleaner according to a first exemplary embodiment of the present invention.
Figure 2:
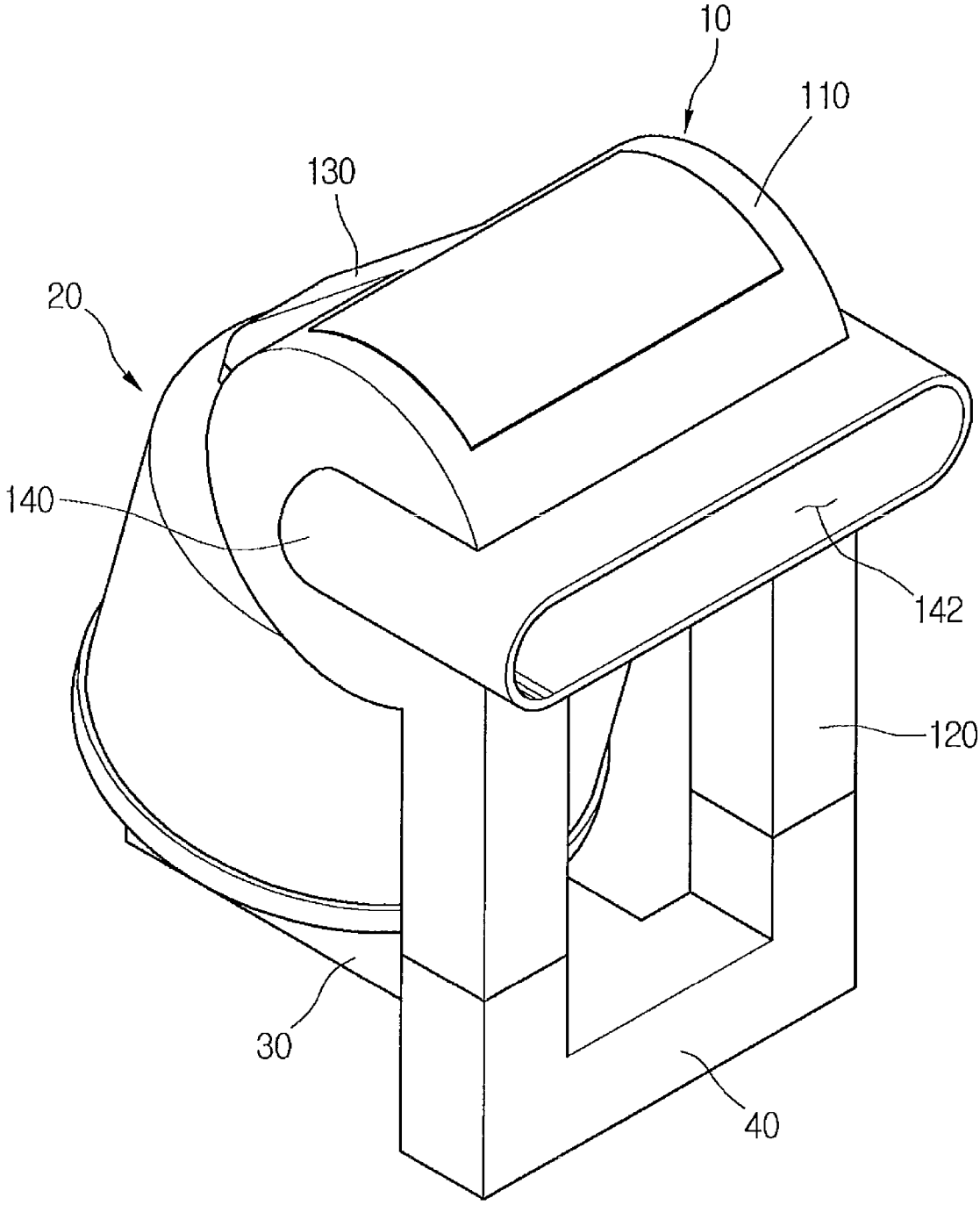
FIG. 2 is a rear perspective view of the dust separating apparatus of FIG. 1.
Figure 3:
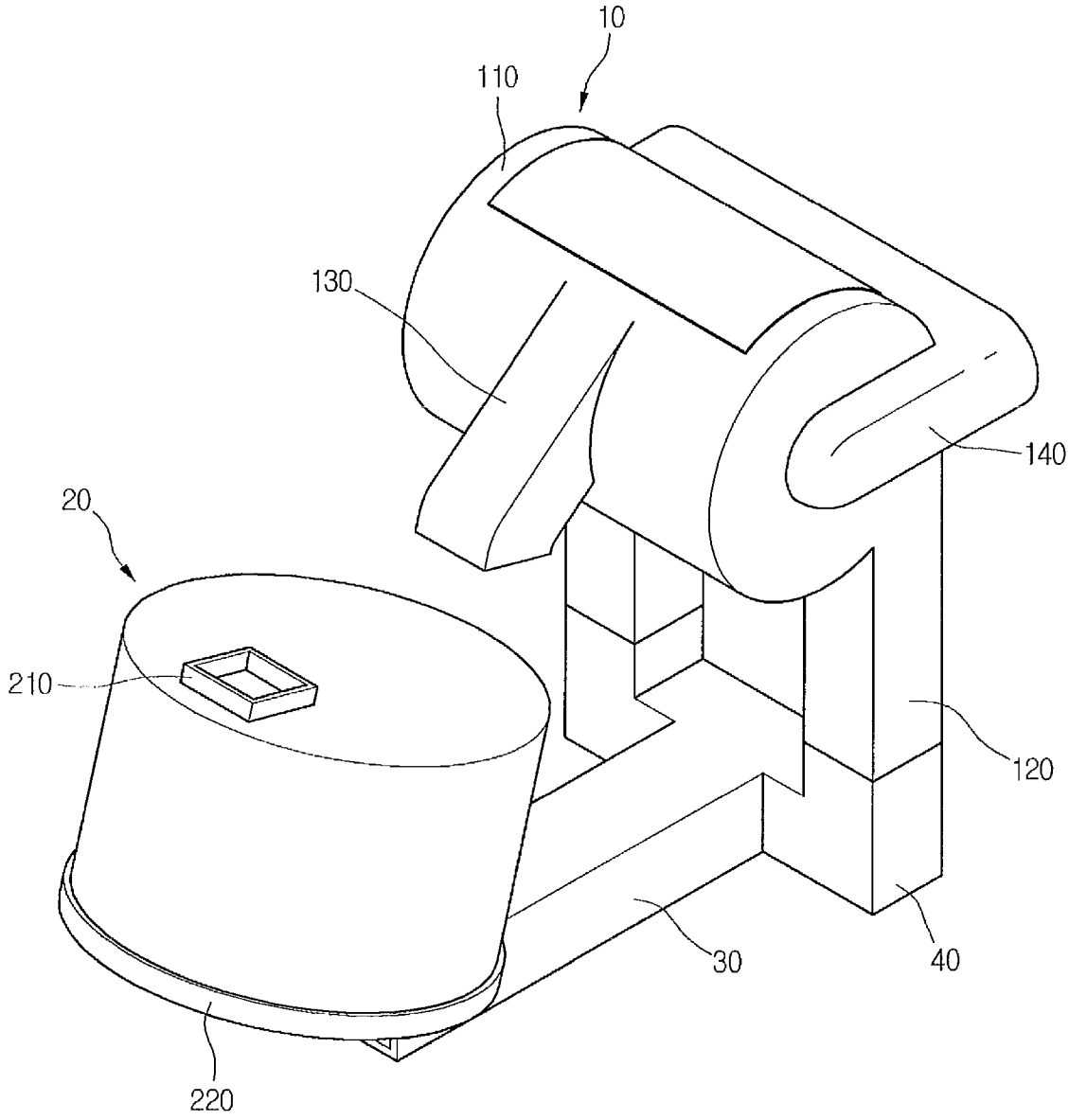
FIG. 3 is a disassembled perspective view of the dust separating apparatus of FIG. 1.

Referring to FIGS. 1 to 3, a dust separating apparatus 1 of a vacuum cleaner according to a first exemplary embodiment of the present invention includes a dust separating unit 10 that separates dust from suctioned air, a dust container 20 for storing dust separated by the dust separating unit 10, a suctioning guide 30 that guides the flow of air including dust toward the dust separating unit 10, and a distribution unit 40 for distributing the air in the suctioning guide 30 to the dust separating unit 10.

In detail, air suctioned through a suctioning nozzle (not shown) flows to the suctioning guide 30. The suctioning guide 30 is provided inside the vacuum cleaner, and is disposed below the dust container 20. The suctioning guide 30 has the distribution unit 40 connected thereto. The dust separating unit 10 separates dust from air supplied from the distribution unit 40. The dust separating unit 10 uses the cyclone principle to separate dust from air, and includes a cyclone 110 for this purpose. The axis of the cyclone 110 extends in a horizontal direction. Thus, the air within the cyclone 110 rotates in a vertical direction.

A pair of air inlets 120 is formed (one on either side) at the cyclone 110 and are arranged to suction air. The pair of air inlets 120 may be formed in tangential directions with respect to the cyclone 110 in order to generate cyclone airflows within the cyclone 110. The pair of air inlets 120 provides suctioning passages for air entering the cyclone 110. Each air inlet 120 is connected at opposite sides of the distribution unit 40. Therefore, the air that flows through the suctioning guide 30 is branched at either side at the distribution unit 40, and the branched air rises along the respective air inlets 120 to be suctioned into the cyclone 110.

A dust outlet 130 that exhausts dust separated within the cyclone 110 is formed at the center of the cyclone 110.

Accordingly, the dust separated from air suctioned through each air inlet 120 at either side of the cyclone 110 moves to the center of the cyclone 110. Next, the dust that flows to the center of the cyclone passes through the dust outlet 130 and is discharged to the dust container 20. In this first exemplary embodiment, the dust outlet 130 is formed tangentially with respect to the cyclone 110 to allow easy discharging of dust. Thus, the dust separated in the cyclone 110 is discharged tangentially with respect to the cyclone 110—that is, in the same direction in which the dust has been rotating—allowing easy discharging of not only dust with higher density, but also easy discharging of dust with lower density from the cyclone 110. Because dust with lower density can easily be discharged, less dust with lower density will accumulate on a filter member (to be described below), thereby facilitating flow of air and improving dust separating performance.

Also, air outlets 140 are formed on opposite sides of the cyclone 110 and are configured to discharge air separated from dust in the cyclone 110. The air discharged through the air outlets 140 converges at a converging passage 142 and enters the main body of the vacuum cleaner (not shown).

The dust container 20 stores dust separated in the dust separating unit 10. Because the dust container 20 is installed on the vacuum cleaner main body, the dust container 20 communicates with the dust separating unit 10. Specifically, when the dust container 20 is installed on the vacuum cleaner main body, the dust container 20 is disposed below the dust separating unit 10. Thus, a dust inlet 210 is formed in the upper side of the dust container 20. Also, the dust outlet 130 extends downward from the cyclone 110 toward the dust inlet 210. Accordingly, the dust separated in the cyclone 110 moves downward along the dust outlet 130, and the separated dust can easily enter the dust container 20.

A cover member 220 is coupled at the bottom of the dust container 20 to discharge dust stored within. The cover member 220 may be pivotably coupled to the dust container 20, and may be detachably coupled thereto, as well. The coupling method of the cover member 220 in the first exemplary embodiment is not restricted to any particular methods. Thus, the dust container 20 is provided as a separate component to the dust separating unit 10, and is configured to be selectively communicable with the dust separating unit 10. Accordingly, a user can separate only the dust container 20 from the vacuum cleaner main body to empty dust stored in the dust container 20.

Because a structure for separating dust within the dust container 20 is not provided, the structure of the dust container 20 is simplified and the weight of the dust container 20 can be minimized. By minimizing the weight of the dust container 20, a user can easily carry and handle the dust container 20, and because the internal structure of the dust container 20 is simple, dust can easily be emptied, and a user can easily clean the inside of the dust container 20.

Figure 4:
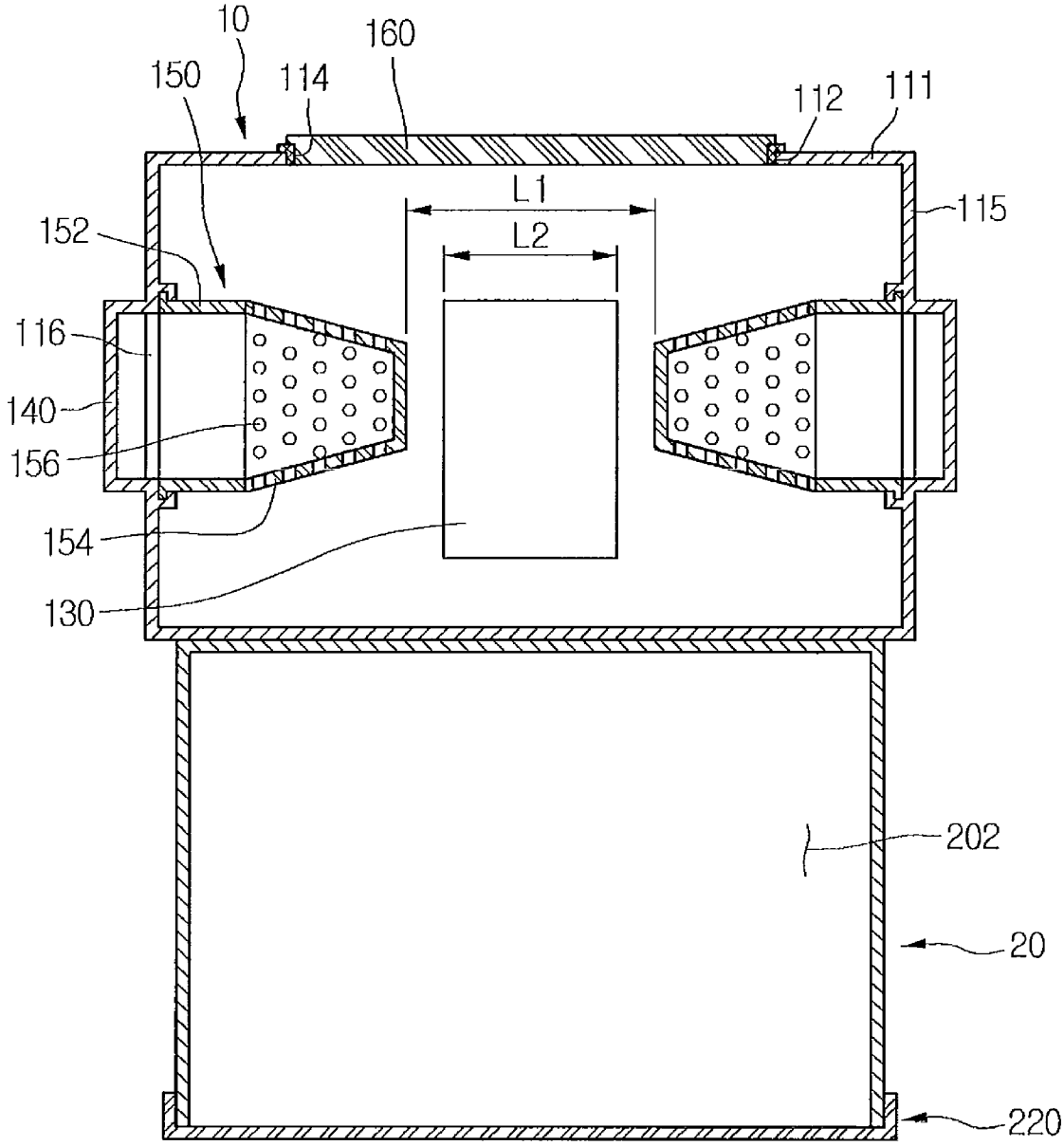
FIG. 4 is a sectional view taken along line IV-IV of FIG. 1.
Figure 5:
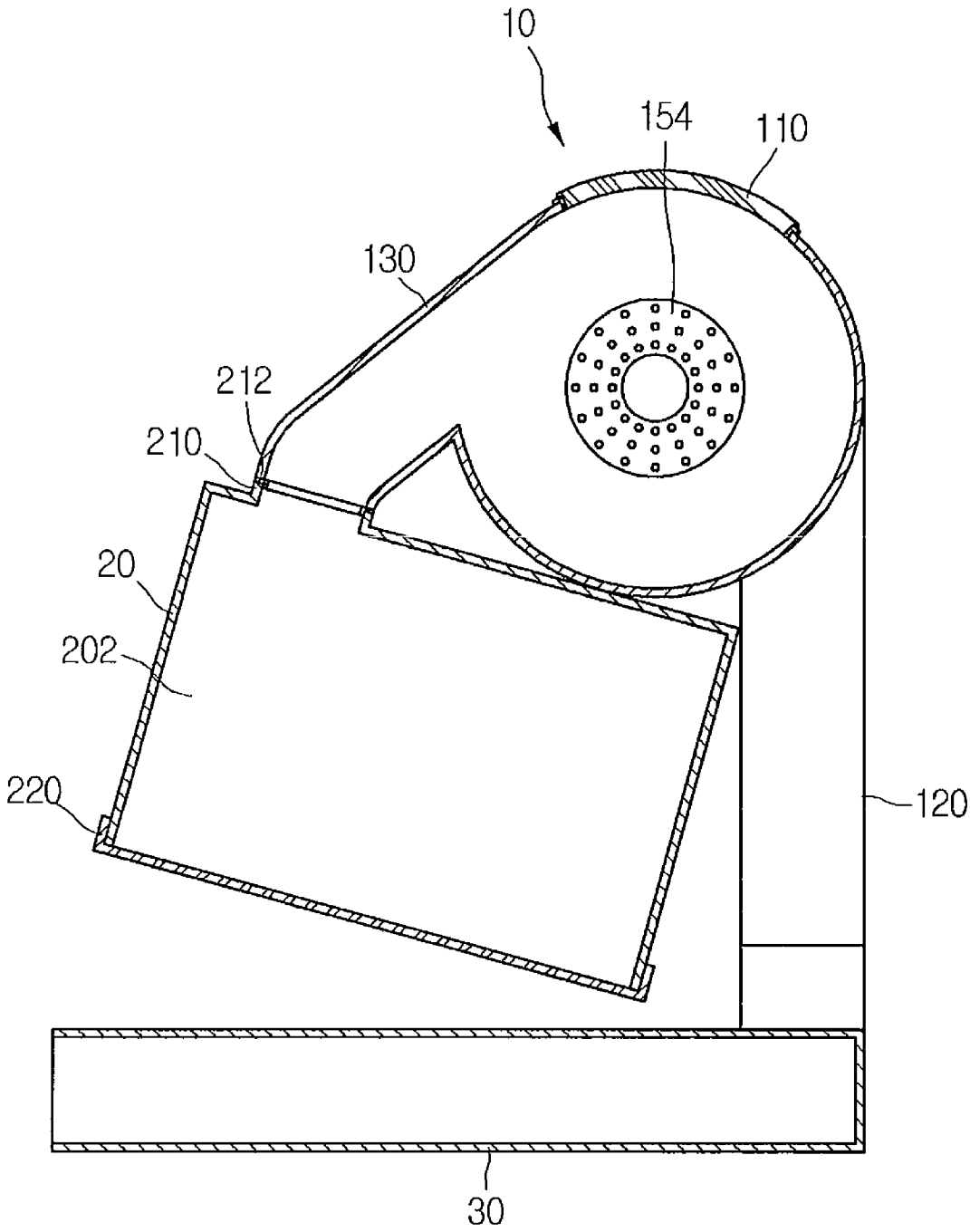
FIG. 5 is a sectional view taken along line V-V of FIG. 1.

Having described the dust separating apparatus 1 according to the first exemplary embodiment generally, a more specific description is provided with reference to FIGS. 4 and 5. Referring to FIGS. 4 and 5, the cyclone 110 includes a body 111 for generating cyclone airflow, and a pair of sides 115, each constituting opposite sides of the body 111. The sides 115 extend parallel to one another.

An air inlet 120 is formed on opposite side of the body 111, respectively. Each air inlet 120 is formed tangentially with respect to the cyclone 110. Thus, the air suctioned through each air inlet 120 forms one of two cyclone airflows within the cyclone 110 and the cyclone airflows circulate along the inner surface of the body 111. Thus, when a pair of cyclone airflows is generated within a single space, the flow volume of air is increased, loss of airflow is reduced, and separating performance can be improved and the cyclone can be formed smaller than with a single cyclone airflow generated in a single space.

In this first exemplary embodiment, even if the cyclone 110 is formed smaller than in the related art, the centrifugal force generated at the air inlets 120 is greater than in the related art, thus improving dust separating performance. Also, when a pair of cyclone airflows is generated in a single space, the same level of dust separating performance as in a structure where air passes through a plurality of dust separating units can be realized. Thus, additional dust separating units for separating dust from air discharged from the dust separating unit are not required. However, additional dust separating units incorporating features of this first exemplary embodiment may be provided.

Furthermore, when a pair of cyclone airflows is generated with one at either side of the cyclone 110 and the cyclone airflows flow toward the center, the cyclone airflow at the center increases. Therefore, a stronger cyclone airflow is generated at the center of the cyclone 110 than at the sides of the air inlets 120. As a result, when the pair of cyclone airflows converges at the center of the cyclone 110, the strength of the airflow is greater than in the case where a single cyclone airflow is generated in a single space, thereby increasing dust separating performance.

Dust that moves to the center of the cyclone 110 can be discharged through the dust outlet 130 to the dust container 20 by means of the strong cyclone airflow, so that dust discharging performance can be increased. In addition, hair and other impurities that normally would adhere to the entrance or the inside of the dust outlet 130 because of static electricity do not adhere to the dust outlet 130 and are easily discharged to the dust container 20 because of the strong cyclone airflow generated at the dust outlet 130.

An outlet 116 is formed to pass through each side 115 to discharge air from which dust is separated in the cyclone 110. Also, a filter member 150 is coupled to each outlet 116 to filter the discharged air. In particular, the filter member 150 is configured with a cylindrical fastener 152 fastened to the inside of the cyclone 110, and a conical filter 154 extending from the fastener 152 to filter air. Also, a plurality of holes 156 is formed in the filter 154 for air to pass through. Accordingly, air separated from dust in the cyclone 110 passes through the plurality of holes 156 and is discharged from the cyclone 110 through the outlets 116.

In this first exemplary embodiment, the fastener 152 does not have through-holes formed therein so that air suctioned through the air inlet 120 is not immediately discharged, but is able to smoothly circulate within the cyclone 110. That is, because of the fasteners 152, the circulation of suctioned air can be guided to generate a smooth cyclone airflow within the cyclone 110, thereby increasing dust separating performance.

As seen in FIG. 4, a length (L1) between the pair of filter members 150 provided within the cyclone may be made greater than a width (L2) of the dust outlet 130. In this first exemplary embodiment, when the length (L1) between the pair of filter members 150 is made smaller than the width (L2) of the dust outlet 130, impurities such as hair and tissue paper are not discharged through the dust outlet 130, and can adhere to the filter member 150 or lodge inside the holes 156. As a result, the air cannot easily pass through the filter member 150, causing a reduction in suctioning force. Accordingly, the length (L1) between the pair of filter members 150 is made greater than the width (L2) of the dust outlet 130 so that impurities such as hair and tissue paper can be completely discharged through the dust outlet 130.

As described above in this first exemplary embodiment, air is suctioned through the plurality of air inlets 120 into the cyclone 110, and air separated from dust in the cyclone 110 is discharged from the cyclone 110 through the plurality of outlets 116. Thus, air that is suctioned into the cyclone 110 through the respective air inlets 120 is discharged through the respective outlets 116 to allow easy discharging of air. When air is thus easily discharged from the cyclone 110, suctioning force is actually increased, and cyclone airflow within the cyclone 110 is smoothly performed. Also, even when dust collects on one of the filter members 150 so that air cannot flow easily therethrough, air can be discharged through the other filter member 150, thereby preventing a sudden loss of air suctioning force.

An opening 112 is formed on the body 111 of the cyclone 110 to allow replacing and cleaning of the filter member 150. The opening 112 is opened and closed by means of a cover member 160. A sealing member 114 is provided at the coupling region of the opening 112 and the cover member 160. In this first exemplary embodiment, the inner surface of the cover member 160 may be formed to have the same curvature as the inner periphery of the body 111 when the cover member 160 is coupled to the body 111. Accordingly, changes to the cyclone airflow due to the cover member 160 within the cyclone 110 can be prevented, and the cyclone airflow can be uniformly maintained. Also, because the cover member 160 is detachably coupled to the cyclone 110, a user can detach the cover member 160 to easily replace the filter members 150 and easily clean the inside of the cyclone 110 and the filter members 150.

A dust compartment 202 for storing dust is defined within the dust container 20, and a dust inlet 210 is defined in the top of the dust container 20. Also, a sealing member 212, for sealing the contacting region between the dust inlet 210 and the dust outlet 130, is provided on the dust inlet 210. Here, the sealing member 212 may also be provided on the dust outlet 130.

Figure 6:
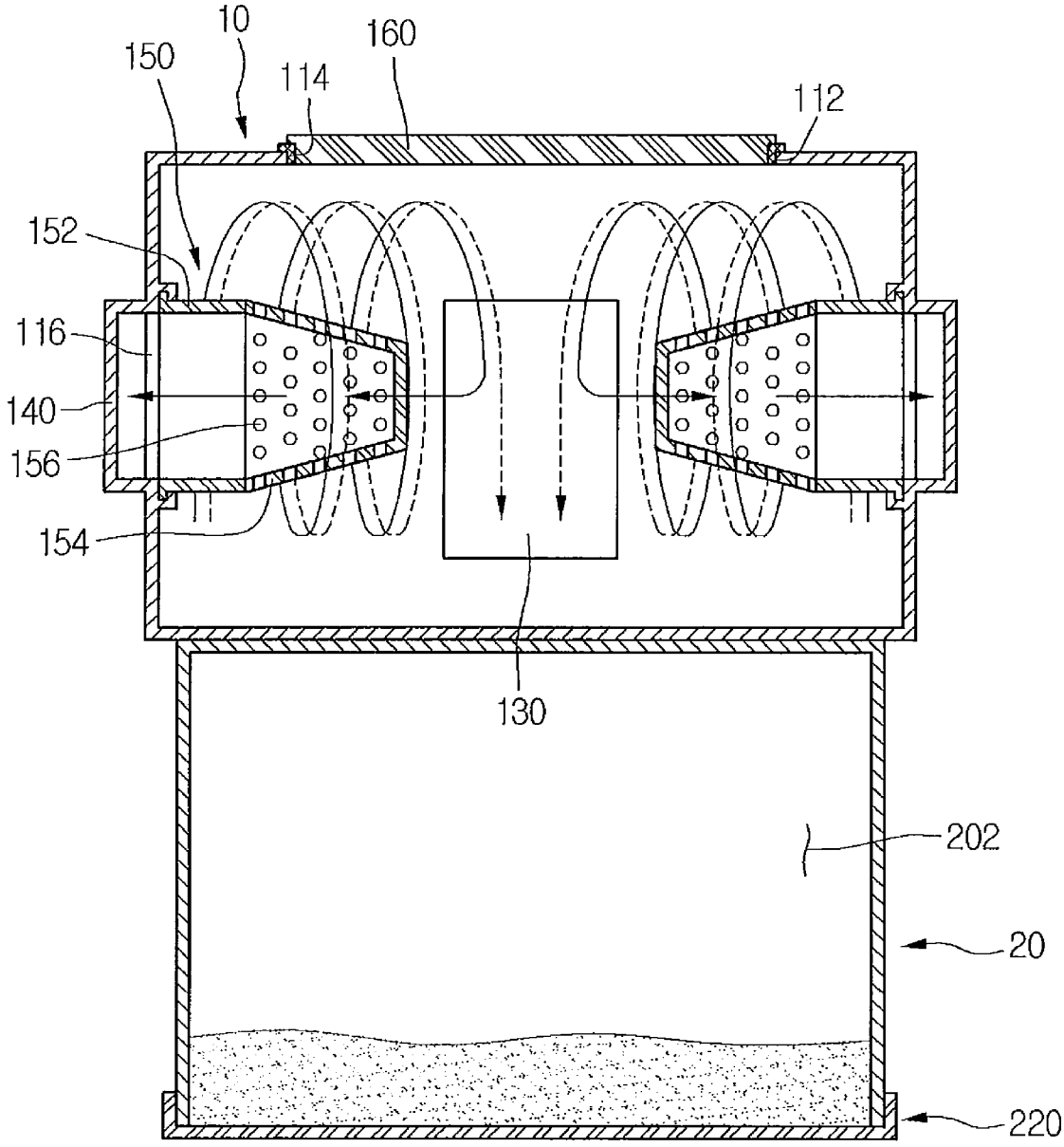
FIG. 6 is a schematic view similar to FIG. 4 showing airflow within the dust separating apparatus of FIG. 1.
Figure 7:
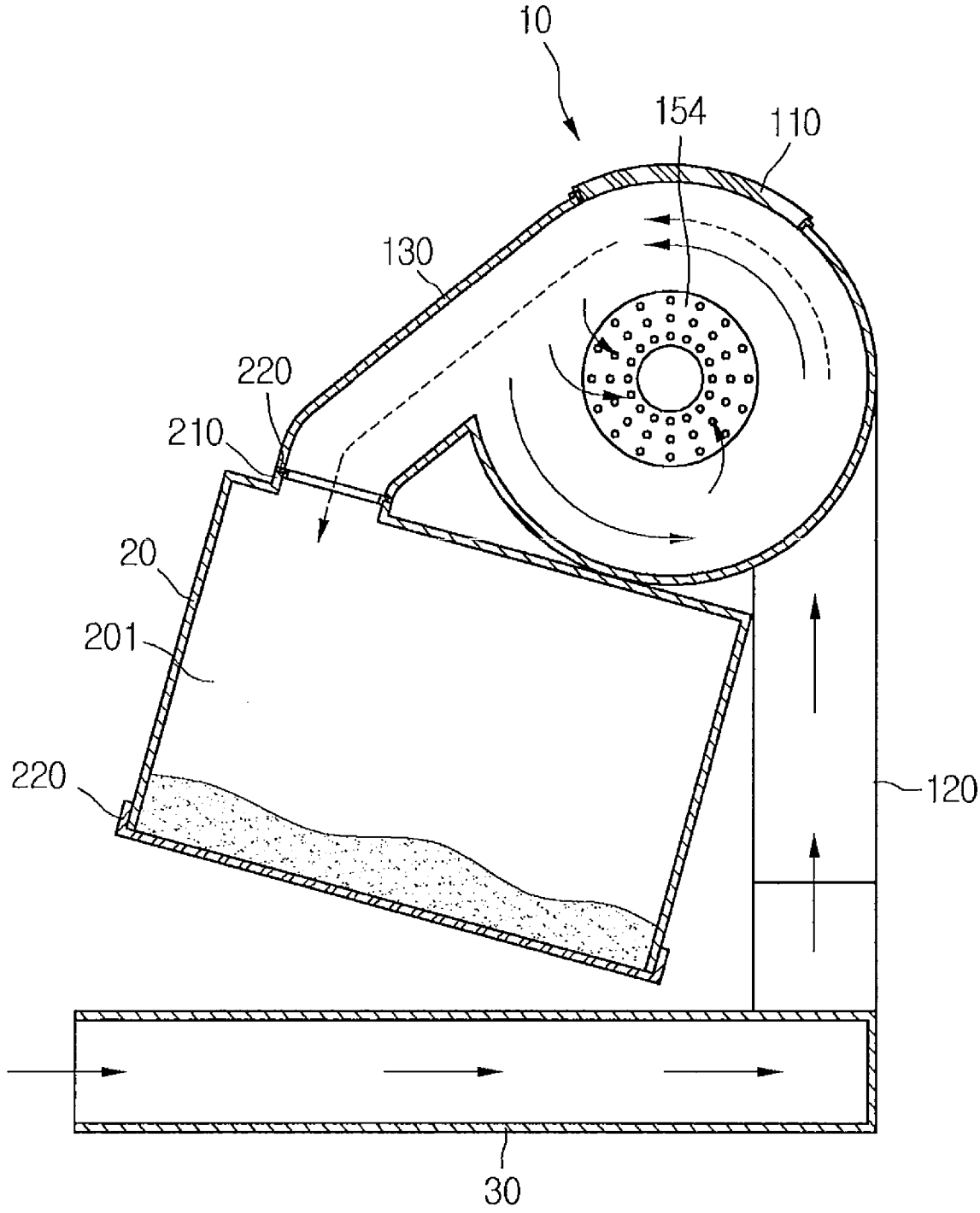
FIG. 7 is a schematic view similar to FIG. 5 showing airflow within the dust separating apparatus of FIG. 1.

The operation of the dust separating apparatus 1 will be described with reference to FIGS. 6 and 7. When suctioning force is generated by the vacuum cleaner, air including dust flows along the suctioning guide 30. The air flowing through the suctioning guide 30 flows to the distribution unit 40 and is distributed to each air inlet 120 by the distribution unit 40. Then, the air, including dust, passes through each air inlet 120 and is suctioned in tangential directions at either side of the cyclone 110.

The suctioned air rotates along the inner surface of the cyclone 110 to move toward and converge at the center of the cyclone 110. During this process, air and dust are subjected to different centrifugal forces due to their differences in weight, so that dust is separated from the air. The separated dust (represented by the broken lines) is discharged from the center of the cyclone 110 through the dust outlet 130, and the discharged dust flows through the dust outlets 130 and into the dust container 20. Conversely, air (represented by the solid lines) separated from dust is filtered by the filter members 150, and then passes through the outlets 116 and is discharged from the cyclone 110. The discharged air flows through the respective air outlets 140, converges at the converging passage 142, and enters the main body of the vacuum cleaner.

Having described a dust separator for a vacuum cleaner according to a first exemplary embodiment above, a dust separator for a vacuum cleaner according to a second exemplary embodiment will be described with reference to FIG. 8. The present exemplary embodiment is the same as the first exemplary embodiment in all other aspects except for the inner structure of the cyclone. Therefore, description will be provided of only the distinguishing portions of the present exemplary embodiment, and the description of portions that are the same as in the first exemplary embodiment will be omitted.

Figure 8:
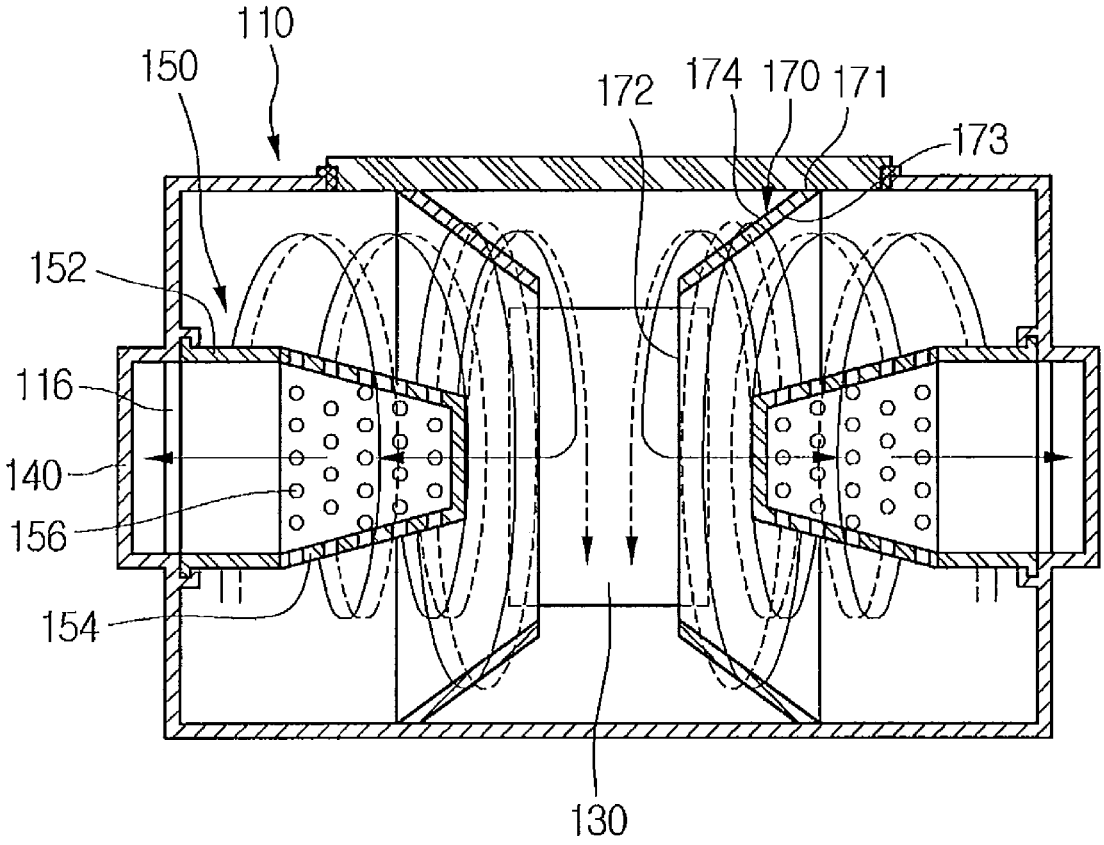
FIG. 8 is a sectional view showing the structure of a dust separating unit according to a second exemplary embodiment of the present invention.

Referring to FIG. 8, according to the present exemplary embodiment, a pair of flow guide member members 170 is formed inside the cyclone 110 to prevent dust separated by cyclone airflow from moving to the outlets 116. In particular, the flow guide members 170 are formed along the inner periphery of the cyclone 110 to form a closed curve. The flow guide members 170 extend a predetermined length from the inner periphery of the cyclone 110 toward the cyclone axis. As a result, the flow guide members 170 extend from the inner periphery of the cyclone 110 toward the dust outlet 130. The flow guide members 170 are formed to have a cross section with a predetermined slope; therefore, one end 171 of the flow guide member 170 has a greater diameter than the other end 172 thereof such that the diameter of the flow guide member 170 is progressively reduced from the outlet 116 toward the dust outlet 130.

In this exemplary embodiment, the cyclone airflow generated at the inlet 120 moves toward the dust outlet 130 along the inner periphery of the cyclone 110. When the diameters of the flow guide members 170 become progressively smaller toward the dust outlet 130, the cyclone airflows are guided by inner, sloped surfaces 173 of the flow guide members 170 to easily flow to the dust outlet 130. Conversely, when the cyclone airflows move toward the other ends 172 of the flow guide members 170, the cyclone airflows flow between outer, sloped surfaces 174 of the flow guide members 170 and the inner periphery of the cyclone 110, and are prevented from flowing toward the outlets 116. As a result, separated dust is prevented from moving to the outlets 116. Therefore, the separated dust circulates within each flow guide member 170, and can be completely discharged through the dust outlet 130.

Because the separated dust is prevented from moving to the outlets 116, the clogging of the holes 156 of the filter member 150 by the separated dust (especially by larger impurities such as tissue paper) can be prevented, and thus, a reduction of suctioning power of air can be prevented. In addition, because the diameter of the flow guide member 170 progressively decreases toward the dust outlet 130, the strength of the cyclone airflows converging at the dust outlet 130 can be increased, thereby allowing the separated dust to be easily discharged. Thus, the respective flow guide members 170 according to the present exemplary embodiment easily guide the cyclone airflows from the outlets 116 toward the dust outlets 130, and guide the cyclone airflows to flow between the respective flow guide members 170 when the cyclone airflows flow to the dust outlet 130.

Furthermore, in this exemplary embodiment, to allow dust flowing along the outer, sloped surfaces 174 of the respective flow guide members 170 to be easily discharged, the one end 172 of the respective flow guide members 170 may be disposed within the opening of the dust outlet 130. That is, at least a portion of the dust outlet 130 is disposed between the respective flow guide members 170. When the one end 172 of the respective flow guide member 170 is disposed within the opening of the dust outlet 130, dust at the outer, sloped surfaces of the respective flow guide member 170 is not discharged through the dust outlet 130, and can be prevented from continuing to circulate along the flow guide members 170.

Figure 9:
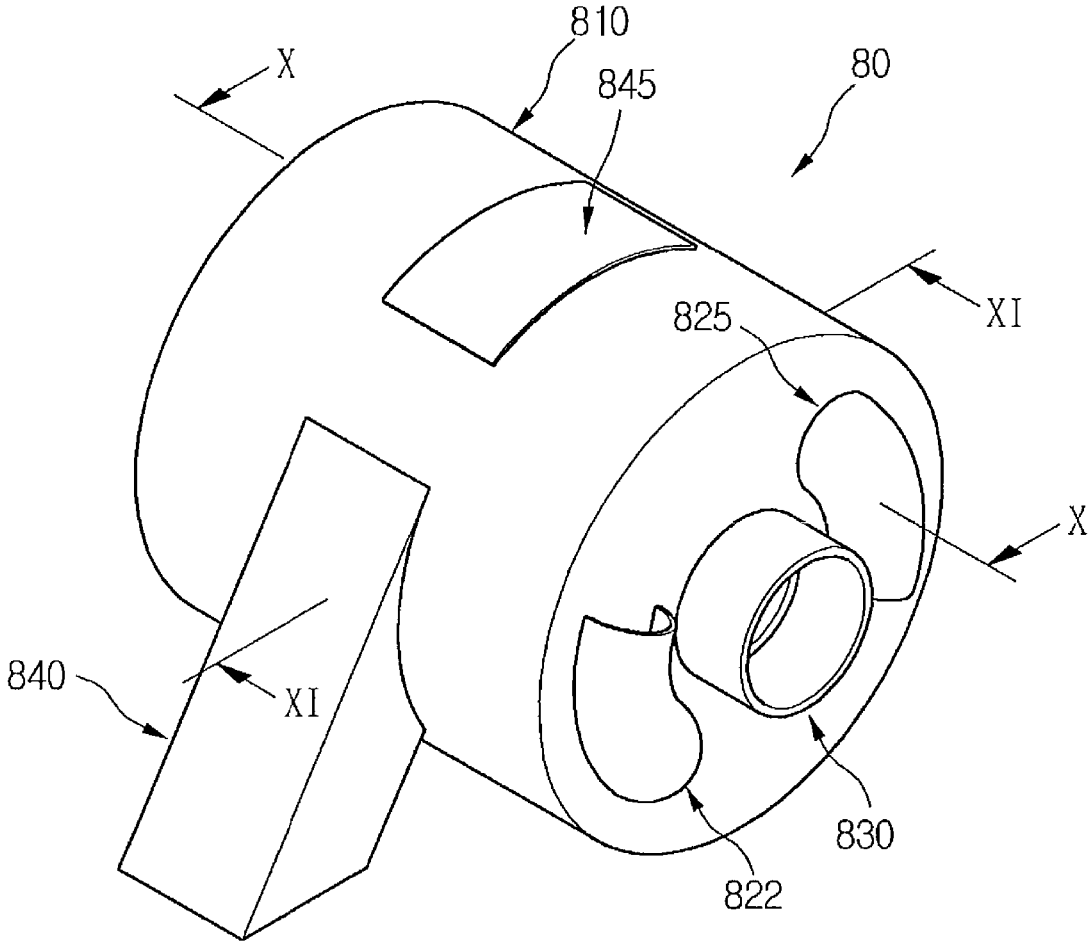
FIG. 9 is a perspective view of a dust separating unit according to a third exemplary embodiment of the present invention.
Figure 10:
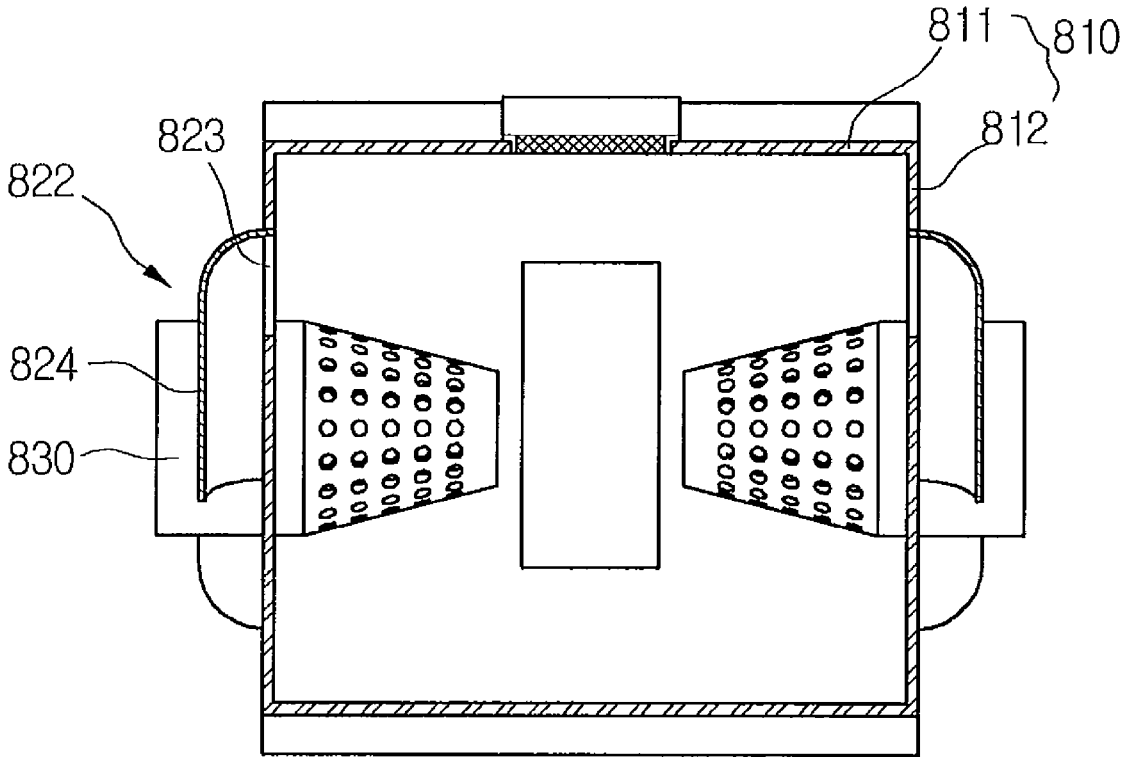
FIG. 10 is a sectional view of FIG. 9 taken along line X-X.
Figure 11:
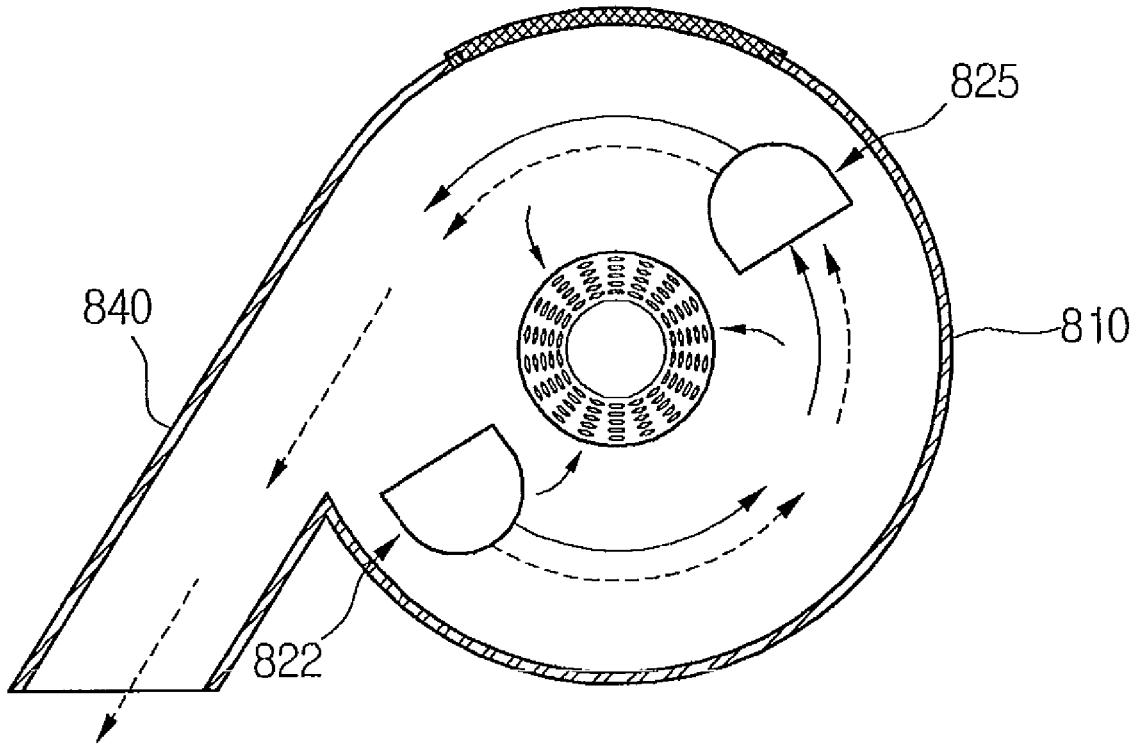
FIG. 11 is a sectional view of FIG. 9 taken along line XI-XI.

Referring to FIGS. 9-11, a dust separating unit 80 according to a third exemplary embodiment is provided. The present exemplary embodiment is the same as the first exemplary embodiment in all other aspects except for the position of the inlet. Therefore, description will be provided of only the distinguishing features of the present exemplary embodiment.

The dust separating unit 80 according to the present exemplary embodiment includes a cyclone 810 for separating dust from air through cyclone airflow, and a dust outlet 840 extending from the cyclone 810 to discharge separated dust. The cyclone 810 includes a body 811 for generating cyclone airflow, and a pair of sides 812 defining both side surfaces of the body 811. Also, a cover member 845 is detachably coupled to the body 811 to allow a user to clean the inside of the body 811.

A pair of inlets 822, 825 is provide at each of the respective sides 812 to suction air therethrough. That is, in the present exemplary embodiment, a total of four inlets are provided at the sides 812. An air outlet 830 is also defined in each of the respective sides 812 to discharge air separated from dust. The air outlet 830 is located in the central portions of the sides 812, and the inlets 822 and 825 are formed at either side of the air outlet 830, respectively.

In this exemplary embodiment, the shapes of the respective inlets 822 and 825 are the same, and therefore, the configuration of only one inlet 822 will be described. As best seen in FIG. 10, the inlet 822 includes a through-hole 823 formed through the side 812, and a flow guide 824 extending from the through-hole 823 to the outside of the cyclone 810. The flow guide 824 guides the formation of a cyclone airflow when air is suctioned into the cyclone 810. That is, because the through-hole 823 is located in the side 812, air would normally flow in at the sides of the cyclone 810, and cyclone airflow would not be easily generated; however, in the present exemplary embodiment, because the flow guide 824 is formed in the side 812, the flow guide 824 allows suctioned air to flow along the inner periphery of the cyclone 810 rather than flowing straight in at the sides.

In addition, the flow guide 824 extends along the outer surface of the side 812 at the through-hole 823 and includes a predetermined curvature. That is, air flows along the flow guide 824 and along the side 812, and passes through the through-hole 822 into the cyclone 810. Thus, in the present exemplary embodiment, because air is suctioned into the cyclone 810 through the plurality of inlets 822, 825 formed in the sides 812, airflow can be easily ensured. Also, because inlets 822, 825 are provided at both sides of the cyclone 810, the inlets 822, 825 may be formed without any restrictions to their positions, such that the inlets 822, 825 may be formed without greatly affecting the size of the dust separating unit 80.

Figure 12:
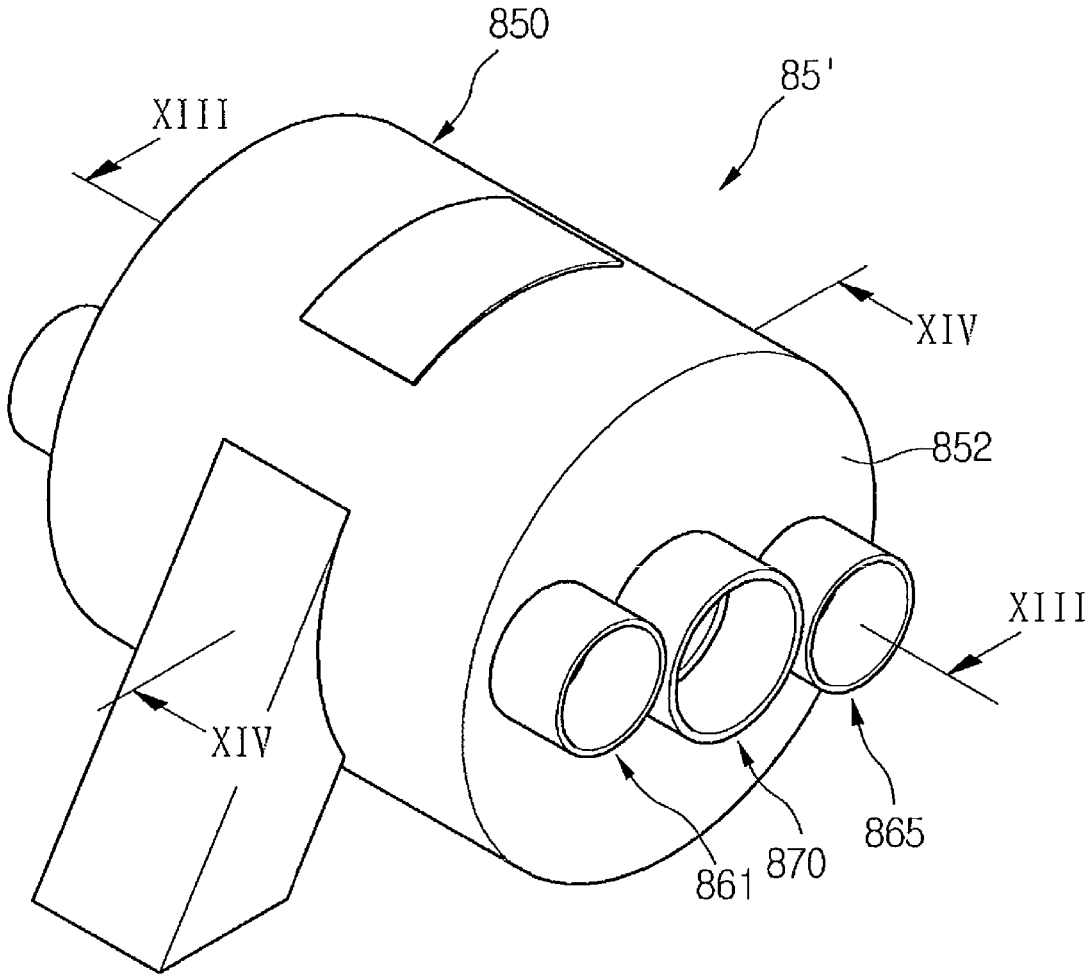
FIG. 12 is a perspective view of a dust separating unit according to a fourth exemplary embodiment of the present invention.
Figure 13:
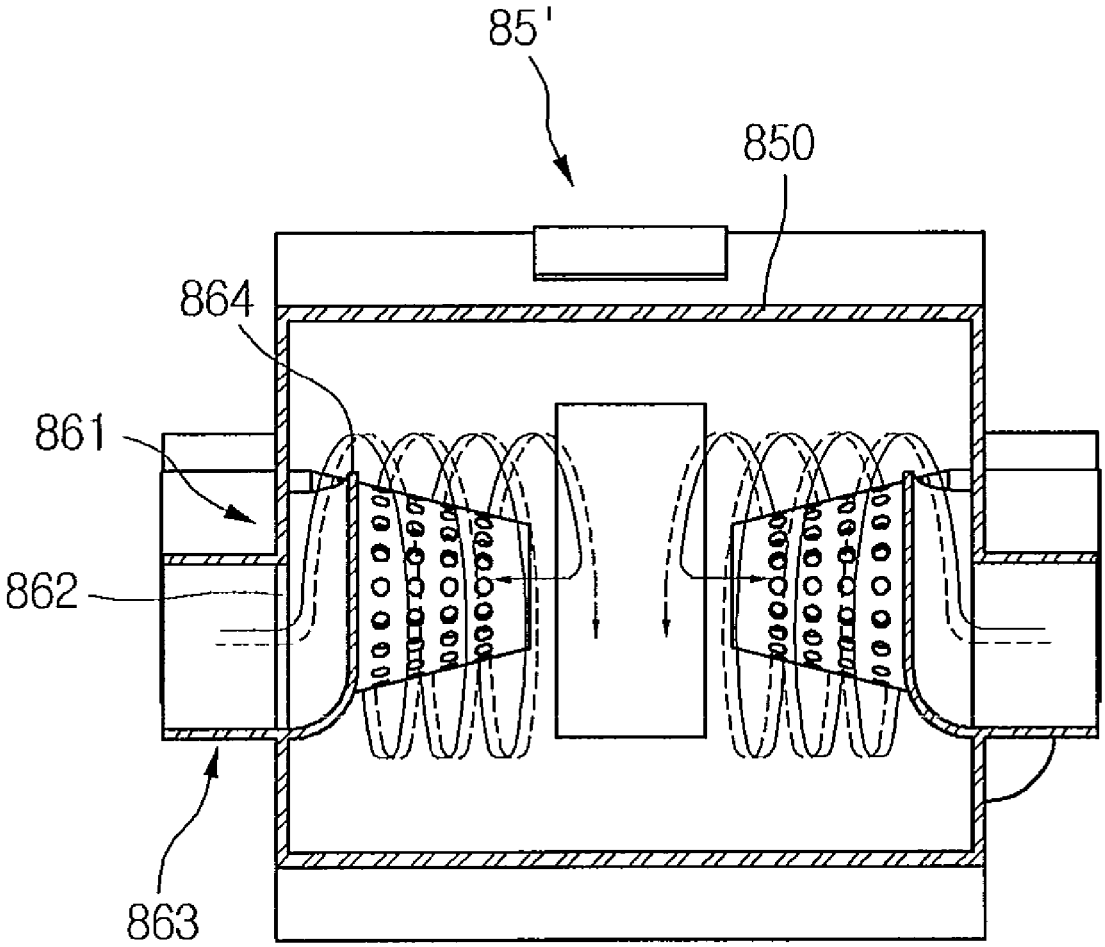
FIG. 13 is a sectional view of FIG. 12 taken along line XIII-XIII.
Figure 14:
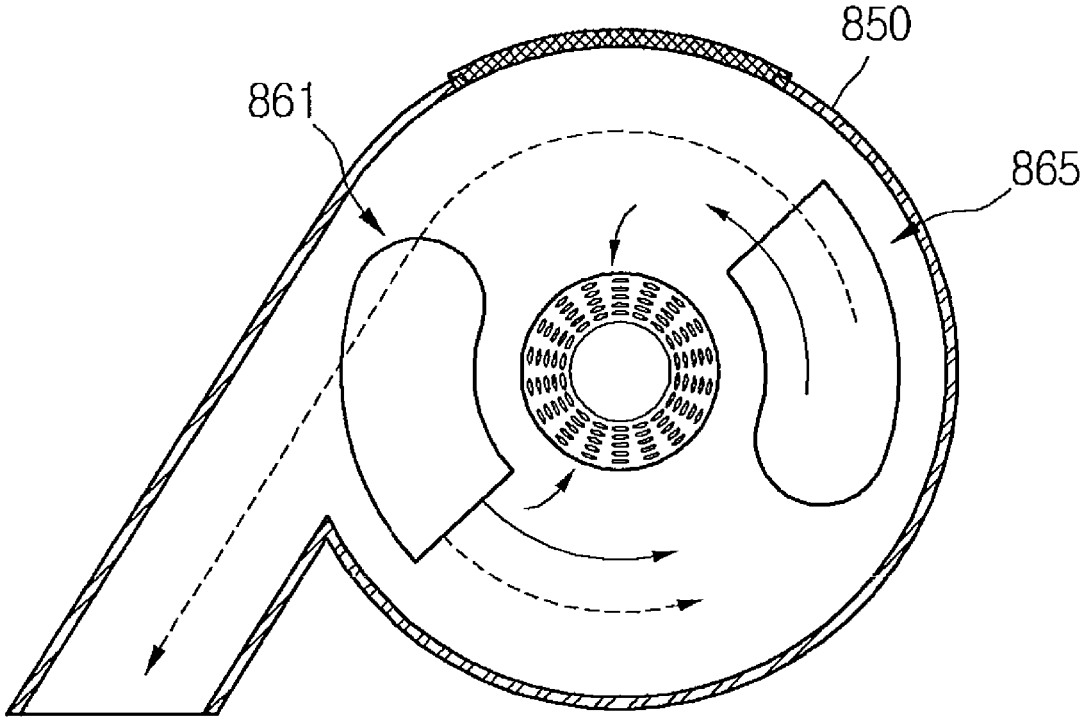
FIG. 14 is a sectional view of FIG. 12 taken along line XIV-XIV.
Figure 15:
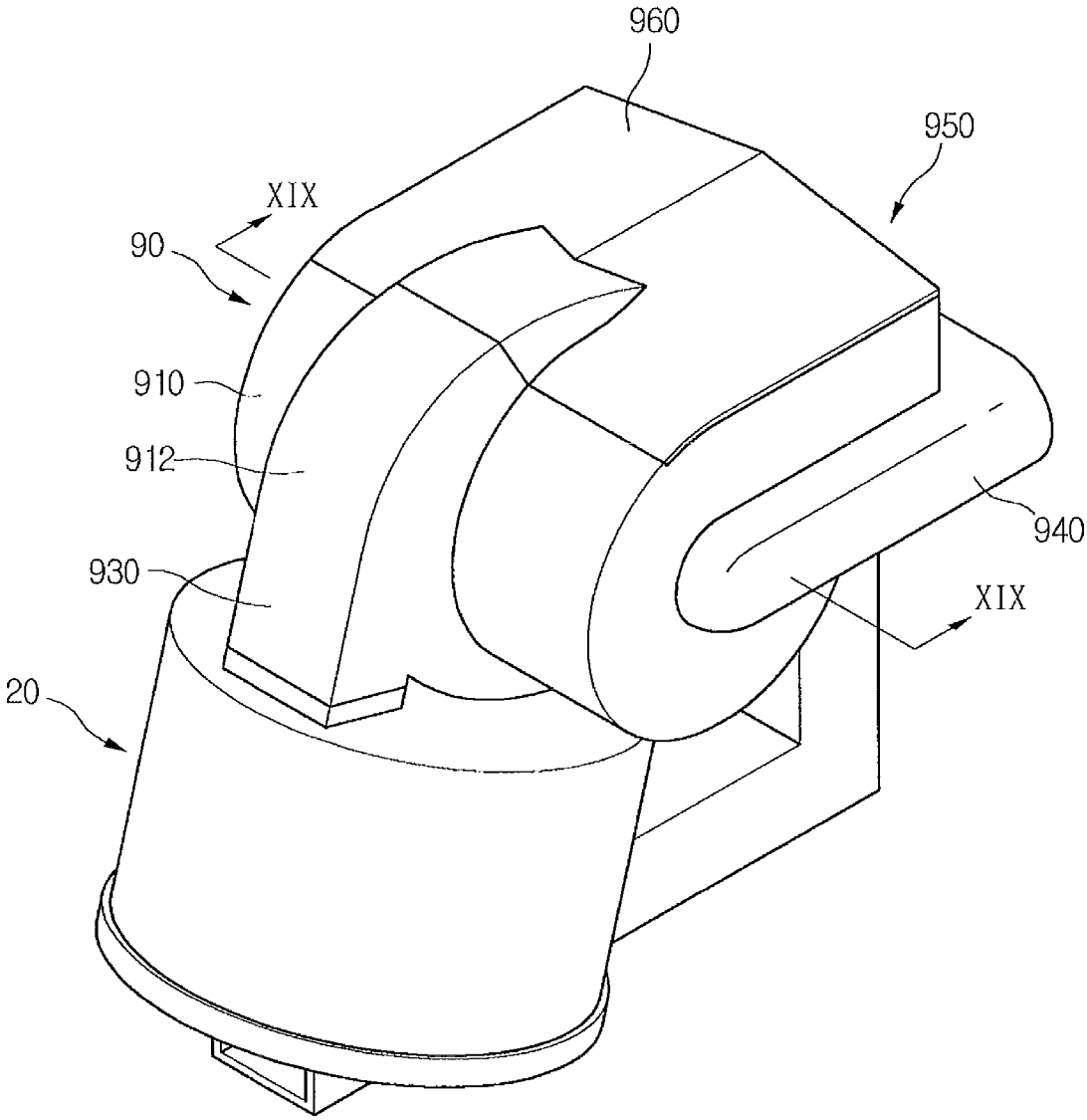
FIG. 15 is a perspective view of a dust separating apparatus according to a fifth exemplary embodiment of the present invention.

Referring to FIGS. 12-14, a dust separating unit 85' according to a fourth exemplary embodiment of the present invention is provided. The present exemplary embodiment is similar the third exemplary embodiment in all other aspects except for the structure of the inlets. Therefore, description will be provided of only the distinguishing features of the present exemplary embodiment.

The dust separating unit 85' according to the present exemplary embodiment includes a cylindrical cyclone 850. A pair of inlets 861, 865 is formed at respective sides 852 of the cyclone 850. An air outlet 870 is also formed in each of the respective sides 852 to discharge air separated from dust. The air outlet 870 is formed at the center of the sides 852, and the inlets 861 and 865 are formed to either side of the air outlet 870, respectively.

In this exemplary embodiment, the shapes of the inlets 861 and 865 are the same, and therefore, the structure of only one inlet 861 will be described. In particular, the inlet 861 includes a through-hole 862 at the side 852 of the cyclone 850, a suctioning guide 863 extending from the through-hole 862 to the outside of the cyclone 850, and a flow guide 864 extending from the through-hole 862 to the inside of the cyclone 850. In this exemplary embodiment, the through-hole 862 is circular in shape, and the suctioning guide 863 is formed in a cylindrical shape. The flow guide 864, as shown in FIG. 14, is formed in a rounded shape of a predetermined curvature to allow air discharged from the flow guide 864 to flow along the inner periphery of the cyclone 850. That is, the curvature of the flow guide 864 is formed to correspond to the curvature of the cyclone 850. Because the direction of air flowing along the flow guide 864 is the same as the direction of air rotating within the cyclone 850, cyclone airflow can easily be achieved within the cyclone 850.

Referring to FIGS. 15-19, a dust separating apparatus according to a fifth exemplary embodiment of the present invention is provided. The present exemplary embodiment is similar to the first exemplary embodiment in all other aspects except in that the distribution unit is formed as part of the cyclone. Therefore, description will be provided of only the distinguishing features of the present exemplary embodiment.

The dust separating apparatus according to the present exemplary embodiment includes a dust separating unit 90 for separating dust from suctioned air, and a dust container 20 for storing separated dust. The dust separating unit 90 includes a cyclone 910 for separating dust from air through a cyclone airflow, a distribution unit 950 for allowing suctioned air to be partitioned and to flow through at least two passages to the cyclone 910, and a cover member 960 for simultaneously covering the cyclone 910 and the distribution unit 950. An expansion portion 912 is formed at the center of the cyclone 910 and has a greater diameter than the portions of the cyclone 910 at either side of the expansion portion 912. A dust outlet 930 is formed at the expansion 912 to discharge separated dust to move to the dust container 20. By providing the distribution unit 950 on the dust separating unit 90, and by having the distribution unit 950 covered by the cover member 960, the inside of the distribution unit 950 can easily be cleaned.

Figure 16:
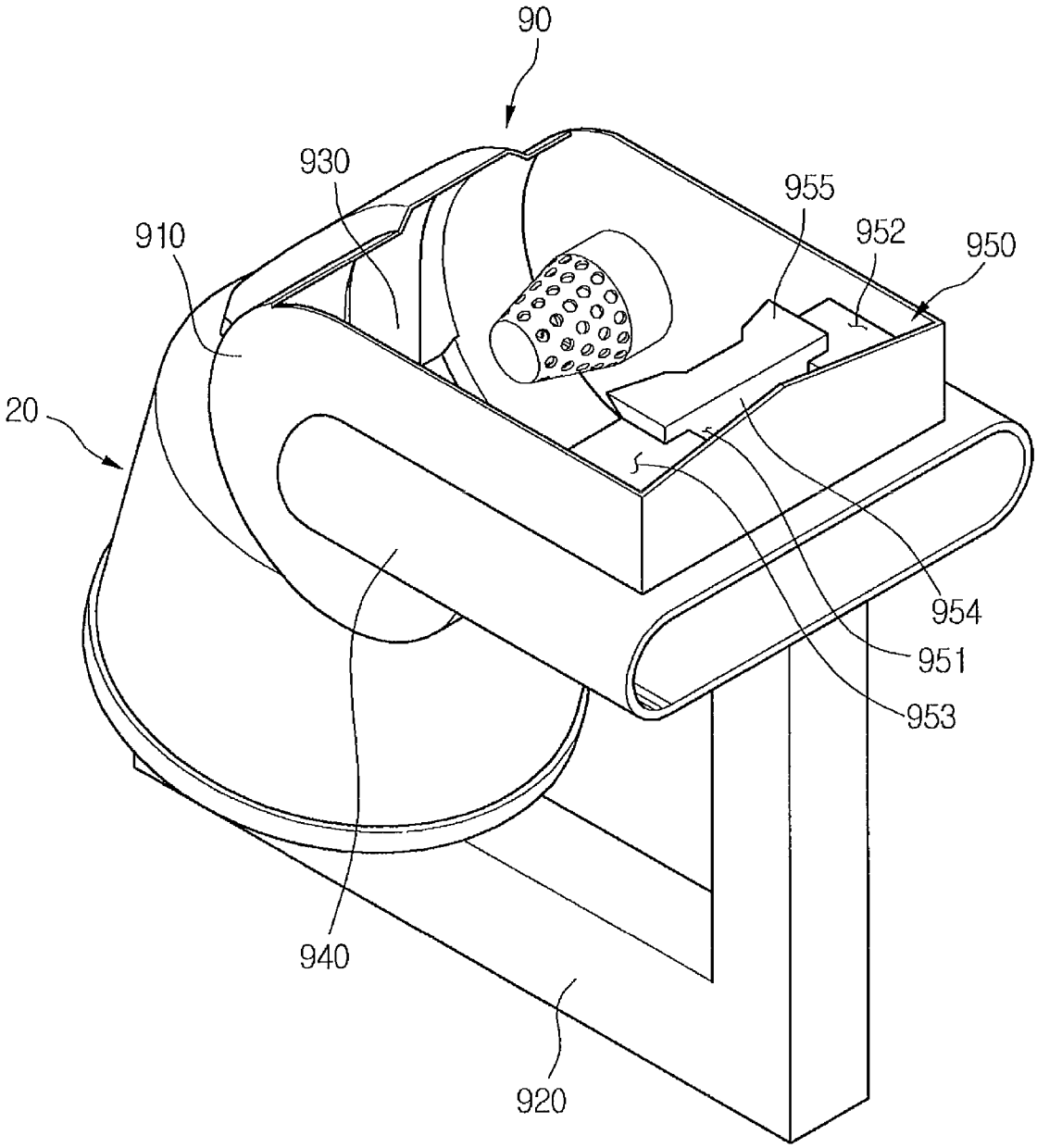
FIG. 16 is a rear perspective view of the dust separating apparatus of FIG. 15 with a cover member removed.

As best seen in FIG. 16, the distribution unit 950 is formed to extend from the cyclone 910 and allows air flowing through the suctioning guide 920 to be partitioned in two directions and to flow to the cyclone 910. The distribution unit 950 includes an inlet 951 for suctioning air that passes through the suctioning guide 920, a first branch passage 952 and a second branch passage 953 into which air suctioned into the distribution unit 950 through the inlet 951 enters, a lower distribution guide 954 for guiding airflow to the respective branch passages 952, 953, and a mount 955 formed to extend from the lower distribution guide 954 to mount the cover member 960 thereon. The branch passages 952, 953 may be referred to as suctioning passages, since air is suctioned therethrough into the cyclone 910.

The lower distribution guide 954 is formed in an overall 'T' shape in order to allow suctioned air to be easily branched. The branch passages 952, 953 are formed at either side of the inlet 951, respectively. The first branch passage 952 and the second branch passage 953 may be formed tangentially to either side of the cyclone 910, respectively, to easily generate cyclone airflow within the cyclone 910.

Figure 17:
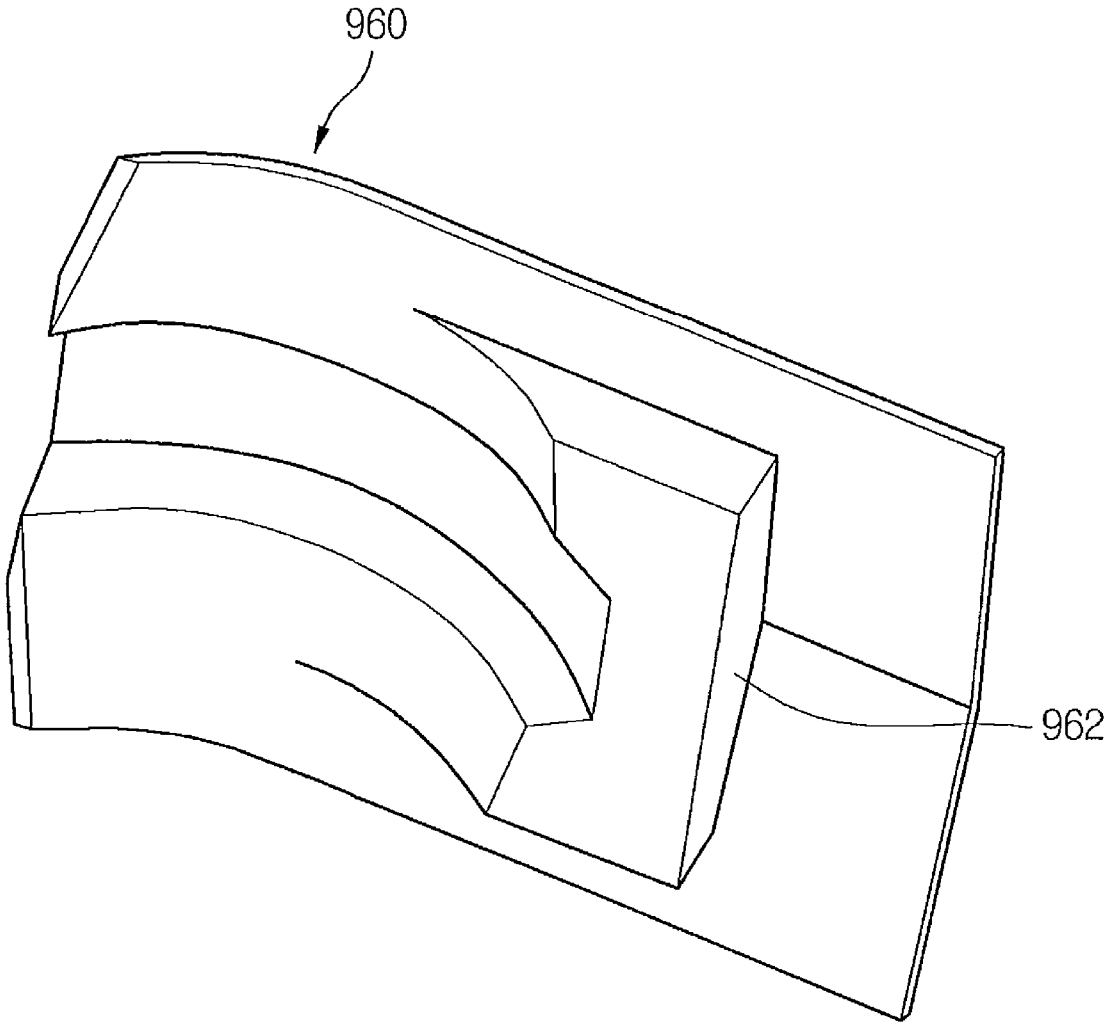
FIG. 17 is an undersurface perspective view of the cover member of the dust separating apparatus of FIG. 15.

As seen in FIG. 17, an upper distribution guide 962 is formed on the undersurface of the cover member 960 to allow air to be distributed to the branch passages 952, 953 when the cover member 960 is mounted on the mount 955. Accordingly, air that passes through the inlet 951 and is suctioned into the dust separating unit 90 is distributed to the respective branch passages 952, 953 by means of the upper and lower distribution guides 962 and 954.

Figure 18:
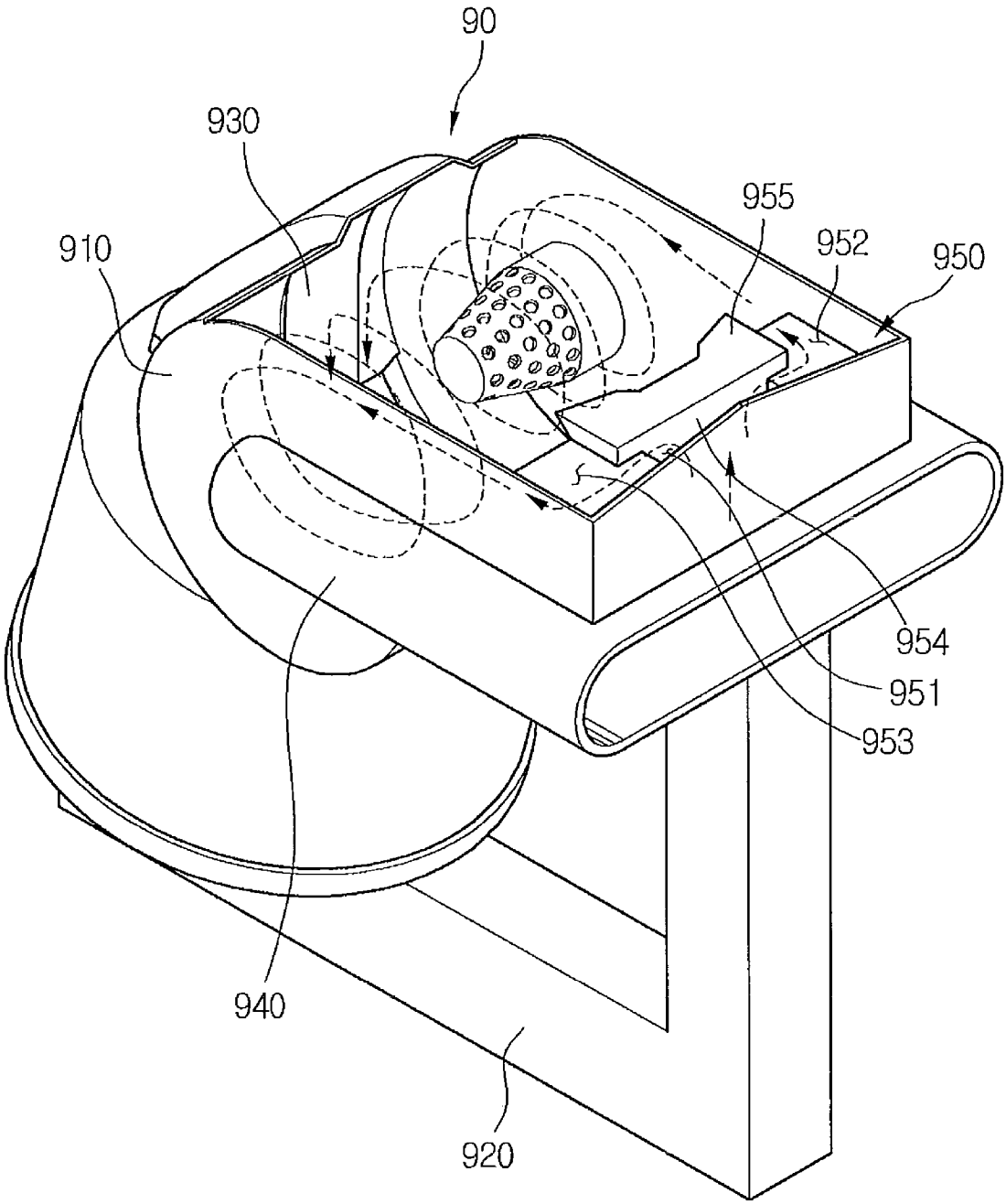
FIG. 18 is a schematic view showing airflow inside the dust separating unit of the dust separating apparatus of FIG. 16.
Figure 19:
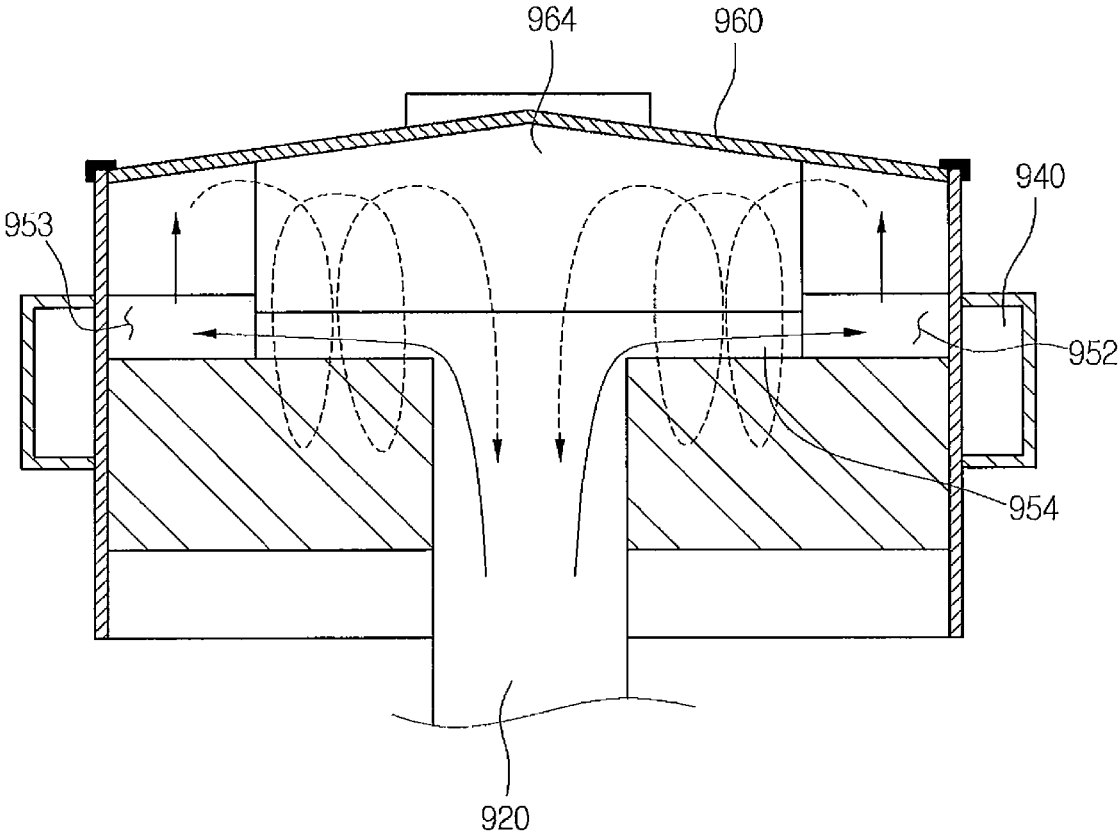
FIG. 19 is a schematic view showing airflow inside the dust separating unit of the dust separating apparatus of FIG. 15 taken along line XIX-XIX.

Referring to FIGS. 18 and 19, airflow within the dust separating unit 90 will be described. First, air suctioned from around a surface to be cleaned flows through the suctioning guide 920, and enters the dust separating unit 90 through the inlet 951. The air suctioned through the inlet 951 is guided by the distribution guides 954 and 962 to either side, and flows into the cyclone 910 through the first branch passage 952 and the second branch passage 953, respectively. Then, the air that enters the cyclone 910 circulates along the inner periphery of the cyclone 910 and moves from either side to the center of the cyclone 910. Dust that is separated from the air is discharged through the dust outlet 930 extending from the cyclone 910. Air separated from the dust is discharged through the air outlet 940 formed at either side of the cyclone 910.

Figure 20:
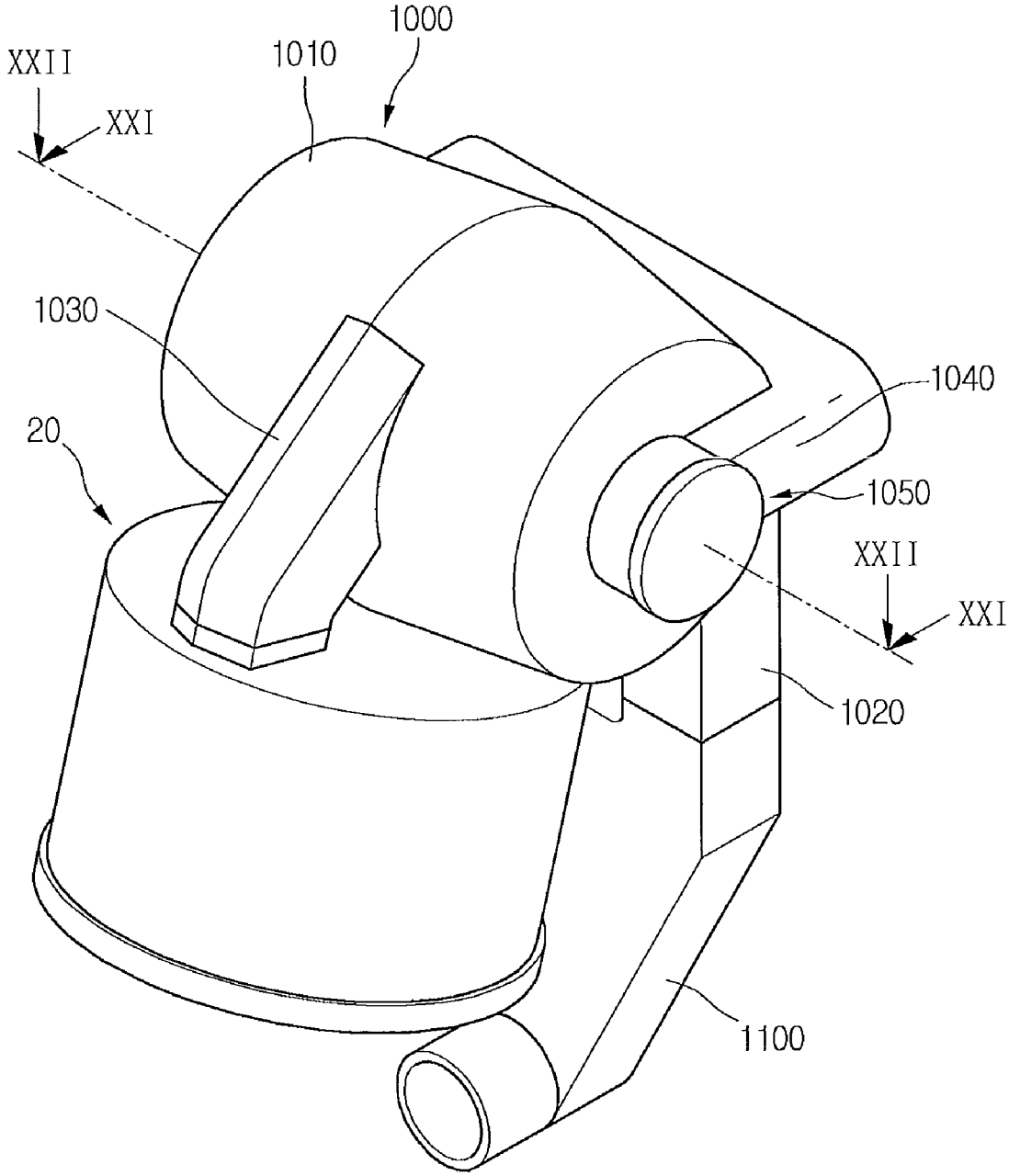
FIG. 20 is a perspective view of a dust separating apparatus according to a sixth exemplary embodiment of the present invention.

Referring to FIG. 20, a dust separating apparatus according to a sixth exemplary embodiment of the present invention is provided. The present exemplary embodiment is similar to the first exemplary embodiment in all other aspects except in that a filter unit for filtering air inside the cyclone is detachably mounted to the cyclone. Therefore, description will be provided of only the distinguishing portions of the present exemplary embodiment.

The dust separating apparatus according to the present exemplary embodiment includes a dust separating unit 1000 for separating dust from suctioned air, a dust container 20 for storing dust separated in the dust separating unit 1000, and a distribution unit 1100 for guiding the flow of air including dust to the dust separating unit 1000. The dust separating unit 1000 includes a cyclone 1010 for separating dust from air through a cyclone airflow. An air outlet 1040 is formed at opposite sides of the cyclone 1010 to discharge air separated from dust. A filter unit 1050 is detachably coupled at the air outlet 1040 to filter air that has undergone dust separation in the cyclone 1010.

Figure 21:
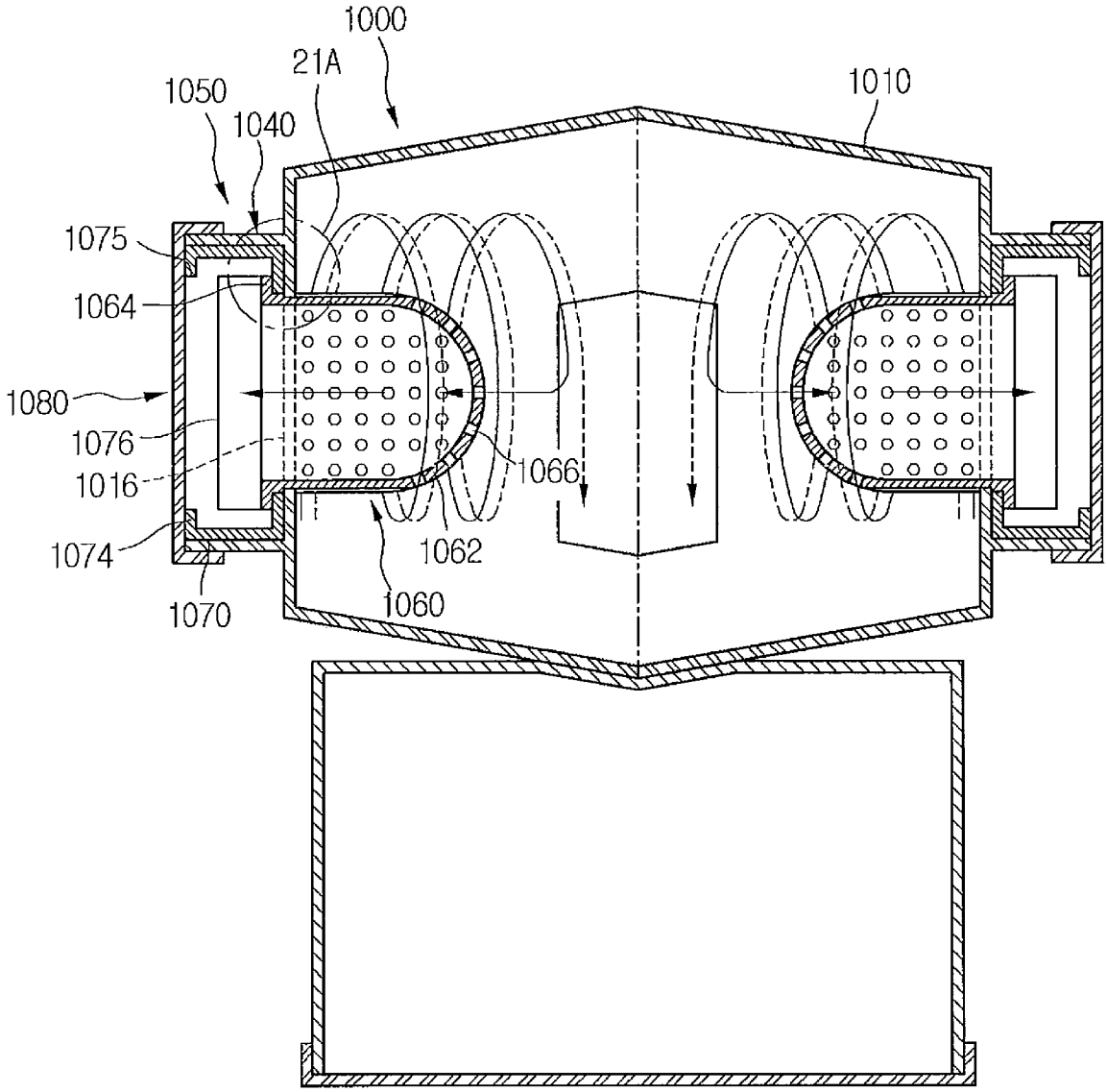
FIG. 21 is a sectional view of FIG. 20 taken along line XXI-XXI and FIG. 21A is a detail view of callout 21A.
Figure 22:
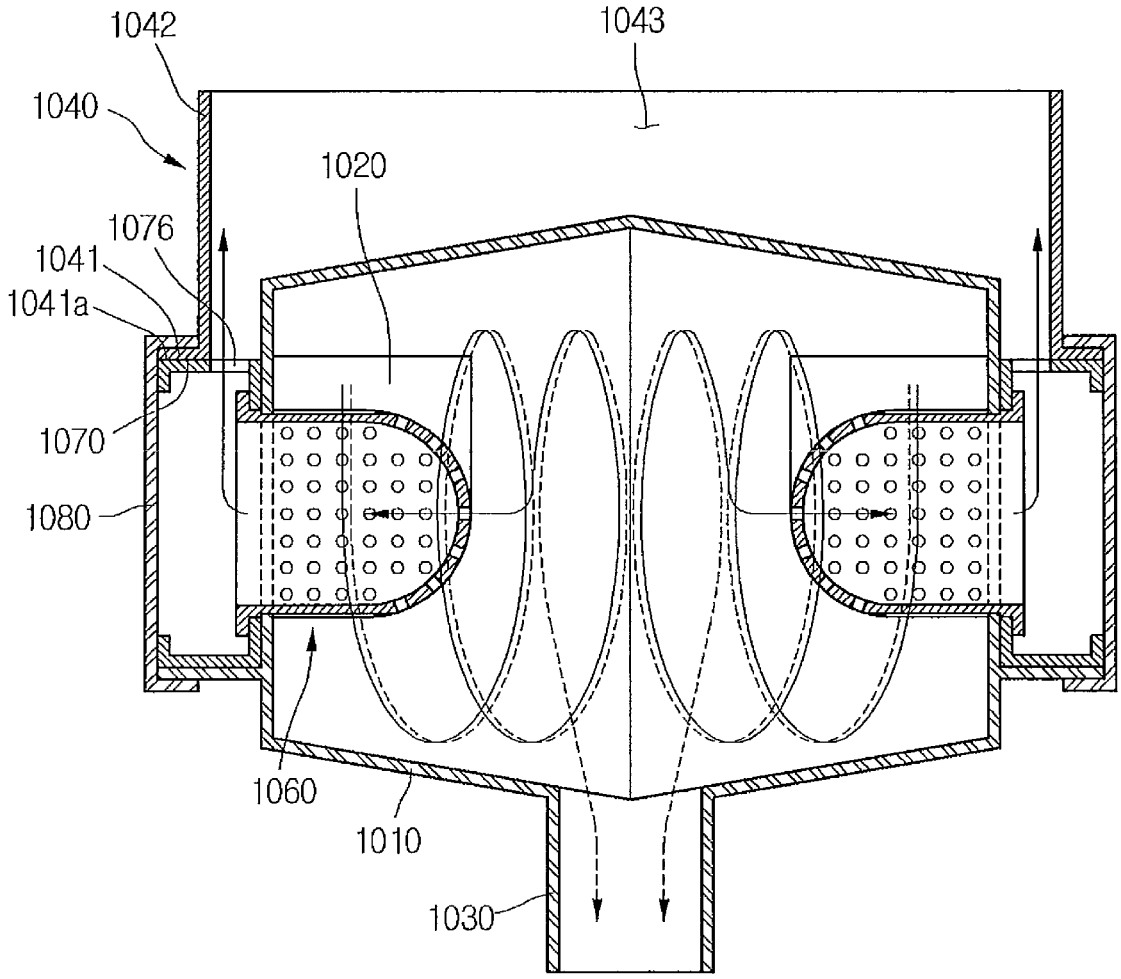
FIG. 22 is a sectional view of FIG. 20 taken along line XXII-XXII.

Referring to FIGS. 21 and 22, an outlet 1016 is provided at opposite sides of cyclone 1010 for discharging air separated from dust in the cyclone 1010. The air outlet 1040 is also connected to the cyclone 1010 at opposite sides of the cyclone 1010. The air outlet 1040 includes a cylinder portion 1041 having a cylindrical shape, and a straight portion 1042 extending from the cylinder portion 1041. The diameter of the cylinder portion 1041 is greater than the width of the straight portion 1042. An opening 1041*a* is defined in a side of the cylinder portion 1041.

The filter unit 1050 is detachably coupled to the cylinder portion 1041. With the filter unit 1050 coupled to the cylinder portion 1041, a portion of the filter unit 1050 passes through the opening 1041*a* and the outlet 1016 and is inserted into the cyclone 1010. In particular, the filter unit 1050 includes a filter member 1060 for filtering air discharged through the outlet 1016, and a supporting member supporting the filter member 1060. The supporting member includes a first supporting member 1070 coupled to the filter member 1060, and a second supporting member 1080 coupled to the first supporting member 1070.

The filter member 1060 includes a filter body 1062 that is partially formed in an approximately cylindrical shape, and a coupler portion 1064 extending vertically from an end of the filter body 1062 toward the outside of the filter body 1062. The couple portion 1064 is coupled to the first supporting member 1070. A plurality of holes 1066 is formed in the filter body 1062 to allow passage of air. The outlet 1016 and the filter body 1062 are formed to have equal diameters. Thus, the filter member 1060 is capable of being inserted inside the cyclone 1010 through the outlet 1016.

The first supporting member 1070 is formed to have an approximately cylindrical shape, and has an outer diameter corresponding to the inner diameter of the cylinder portion 1041. A first through-hole 1073, through which the filter body 1062 passes, is provided in a first side 1072 of the first supporting member 1070 adjacent to the cyclone 1010. A second through-hole 1075 is formed in a second side 1074 that is opposite to the first side 1072 and has a diameter equal to or greater than that of the coupler 1064. That is, because the coupler 1064 extends to the outside of the filter body 1062, and because the diameter of the coupler 1064 is greater than the diameter of the filter body 1062, the second through-hole 1075 is formed larger than the first through-hole 1072 to allow the filter member 1060 to pass through the first supporting member 1070. A flow hole 1076, through which air can pass, is defined in the first supporting member 1070. Accordingly, air separated from dust in the cyclone 1010 passes through the holes 1066, the outlet 1016, and the flow hole 1076.

The filter member 1060 is inserted from the second side 1074 toward the first side 1072 into the first supporting member 1070. When the filter member 1060 is completely inserted in the first supporting member 1070, the filter body 1062 passes through the first through-hole 1073 of the first side 1072, and the coupler 1064 is pressed against the first side 1072. The first side 1072 and the coupler 1064, in one example, may be coupled through ultrasonic bonding. However, there are no restrictions to the method used for bonding the coupler 1064 and the first supporting member 1070.

The second supporting member 1080 has one side formed in an open cylindrical shape. The inner diameter of the second supporting member 1080 corresponds to the outer diameter of the cylinder portion 1041. With the filter member 1060 coupled to the first supporting member 1070, the second supporting member 1080 is coupled to the second side 1074 of the first supporting member 1070. The first supporting member 1070 and the second supporting member 1080 may also be coupled through ultrasonic bonding. When the first supporting member 1070 is pressed against the inner surface of the cylinder portion 1041, the second supporting member 1080 encloses the outer surface of the cylinder portion 1041. The inner diameter of the cylinder portion 1041 and the outer diameter of the first supporting member 1070 are configured to correspond to each other, and the outer diameter of the cylinder portion 1041 and the inner diameter of the second supporting member 1080 are also configured to correspond to each other, so that the filter unit 1050 may be coupled to the cylinder portion 1041 through press-fitting, without using additional fastening means.

The reason for providing detachable coupling of the filter unit 1050 to the cyclone 1010 is to allow easy removal of hair and other impurities that may be wound around the filter member 1060. In particular, hair and other impurities wound around the filter member 1060 are caught at a perimeter 1017 of the outlet 1016 and are removed from the filter member 1060 when the filter unit 1050 is partially pulled out of the cyclone 1010. That is, because the outlet 1016 and the filter member 1060 are formed to have corresponding diameters, and because a portion of the filter member 1060 remains inside the cyclone 1010, hair and other impurities can fall downward as they are brought into contact with the perimeter 1017 of the outlet 1016. Accordingly, by pulling the filter unit 1050 to the outside of the cyclone 1010, the filter member 1060 can be cleaned, thereby negating the inconvenience of a user having to directly clean the filter member 1060 and preventing a user from having to directly handle impurities.

Figure 21A:
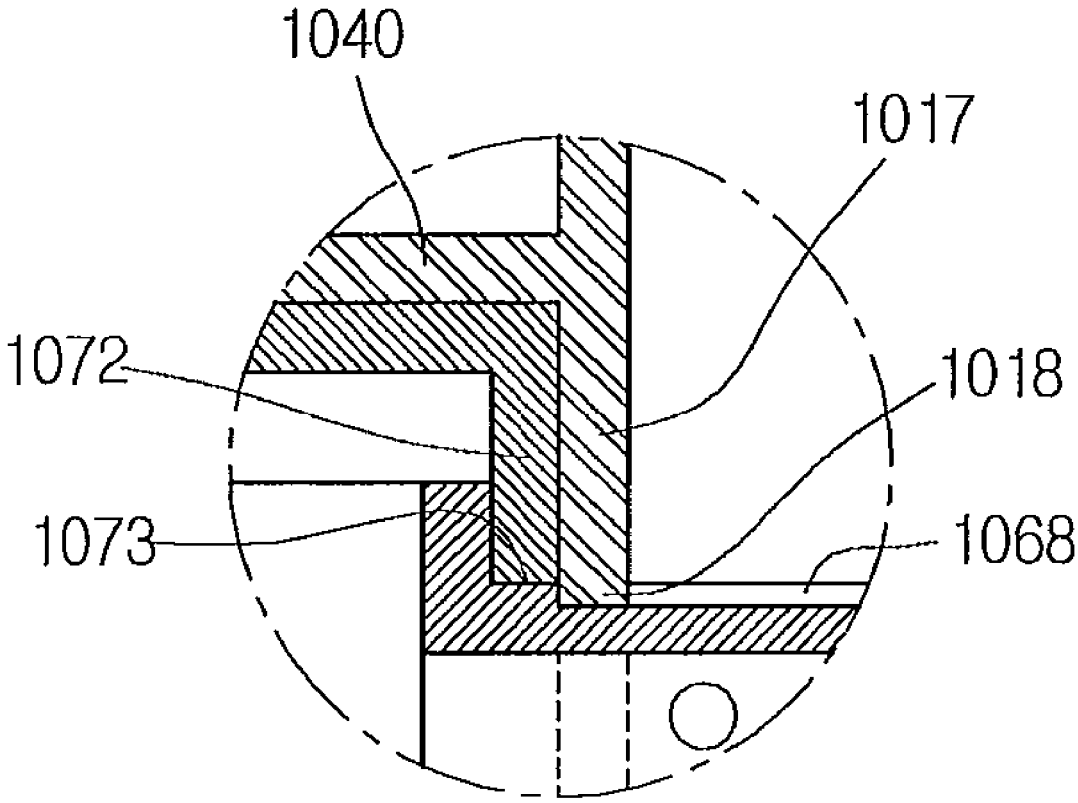

To more effectively enable removal of hair wrapped around the filter member 1060, a protrusion 1018 (best seen in FIG. 21A) may be formed on the perimeter 1017 of the outlet 1016, and a protrusion receiver 1068 in which the protrusion 1018 is inserted is formed in the outer surface of the filter body 1062. Accordingly, with the protrusion 1018 inserted in the protrusion receiver 1068, when the filter member 1060 is pulled outward, the hair and other impurities wrapped around the filter member 1060 can easily be removed from the filter member 1060 by means of the protrusion 1018.

Figure 23:
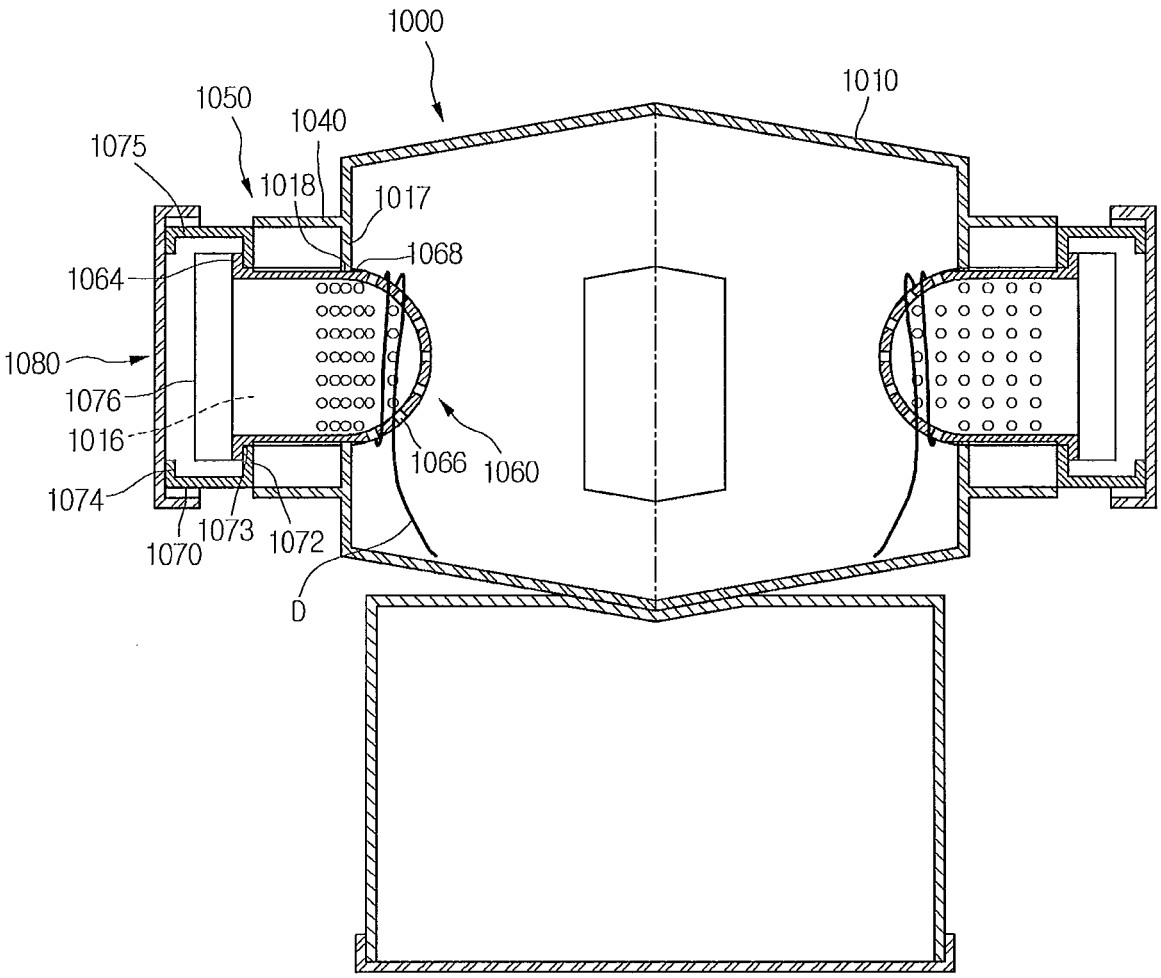
FIG. 23 is a sectional view showing the dust separating unit of FIG. 20 with a filter unit being removed.

Referring to FIGS. 21 to 23, the process for removing hair and other impurities will be described. In particular, to remove hair and other impurities (D) wrapped around the filter member 1060, the filter unit 1050 is pulled to the outside of the cyclone 1010. Then, while the filter member 1060 is being withdrawn from the outlet 1016, the protrusion 1018 removes hair and other impurities wrapped around the filter member 1060, and the hair and other impurities that are removed fall inside the cyclone 1010. After hair and other impurities wrapped around the filter member 1060 are removed, the filter unit 1050 is pushed back against the cyclone 1010. Then, the filter member 1060 passes through the outlet 1016 and is inserted into the cyclone 1010.

Having described several exemplary embodiments of the present invention, one or more of these exemplary embodiments may provide various advantages over the related art dust separating apparatuses. For example, because a plurality of air inlets is formed in a dust separating apparatus, and a plurality of cyclone airflows is formed within the dust separating apparatus, the airflow volume is increased and airflow loss is reduced, thereby improving dust separating performance.

Also, because air inlets are formed at either side of the dust separating apparatus, and a dust outlet is formed in the center of the dust separating apparatus, a forceful cyclone airflow is generated at the central portion of the dust separating apparatus to allow dust to be easily discharged.

Furthermore, because a dust outlet is formed tangentially to the dust separating apparatus, the dust can be discharged in the same direction in which it has been rotating. Thus, not only can dust of higher density be easily discharged, dust of lower density can also be discharged easily from the dust separating apparatus.

Because a cover member is detachably coupled to the dust separating apparatus, a user can easily clean the inside of the dust separating apparatus and the filter member.

Moreover, when a filter member for filtering air discharged from the cyclone is configured to be inserted into the cyclone from the outside, and when the filter member is configured to be separable to the outside of the cyclone, the filter member can be cleaned during the process of separating the filter member. Accordingly, a user does not have to directly clean the filter member such that impurities adhering to the user's hands when the user cleans the filter member can be prevented.

Furthermore, because a dust container that stores dust is provided as a separate component from a dust separator, a user can empty dust by separating only the dust container, thereby increasing user convenience in handling the dust container. Moreover, because a structure for separating dust within the dust container is not provided, the structure of the dust container is simplified, and the weight of the dust container is minimized, thereby increasing user convenience. Additionally, by simplifying the internal structure of the dust container, emptying of dust stored in the dust container can easily be performed.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dust separating apparatus for a vacuum cleaner, the dust separating apparatus comprising:

a cyclone configured to provide a plurality of cyclone airflows therein, the cyclone having a first air inlet and a second air inlet configured to receive an airflow containing dust, a first air outlet located at a first side of the cyclone, a second air outlet located at a second side of the cyclone, and a dust outlet configured to discharge dust separated by the plurality of cyclone airflows, the dust outlet being disposed between the first air inlet and the second air inlet;

a first filter unit connected to the first side of the cyclone to filter air, the first filter unit being in communication with the first air outlet;

a second filter unit connected to the second side of the cyclone to filter air, the second filter unit being in communication with the second air outlet; and a dust container to collect dust discharged from the dust outlet, wherein a length between the first filter unit and the second filter unit is shorter than a length between the first air inlet and the second air inlet.

2. The dust separating apparatus of claim 1, wherein at least a portion of the first filter unit is inserted through the first air outlet from an outside of the cyclone and at least a portion of the second filter unit is inserted through the second air outlet from the outside of the cyclone.

3. The dust separating apparatus of claim 1, wherein the first and second air outlets are arranged on a longitudinal axis of the cyclone, and the longitudinal axis is oriented in a horizontal direction.

4. The dust separating apparatus of claim 1, wherein the plurality of cyclone airflows is formed in a single space within the cyclone.

5. The dust separating apparatus of claim 1, wherein the cyclone includes a third air inlet to receive the airflow containing dust, and a fourth air inlet to receive the airflow containing dust, the third and fourth air inlets being spaced apart from each other.

6. The dust separating apparatus of claim 1, wherein the cyclone includes a guide member formed therein, the guide member being located adjacent to the dust outlet to prevent separated dust from moving to the first air outlet.

7. The dust separating apparatus of claim 1, wherein a length between the first filter unit and the second filter unit is greater than a width of the dust outlet.

8. The dust separating apparatus of claim 1, further comprising a distribution unit formed integrally with the cyclone, the distribution unit including a first inlet passage to direct the airflow containing dust toward the first air inlet.

9. The dust separating apparatus of claim 8, further comprising a cover member configured to open and close the cyclone and the distribution unit.

10. The dust separating apparatus of claim 9, wherein the cyclone includes a second air inlet to receive the airflow containing dust, and the dust separating apparatus further includes a distribution guide formed on the distribution unit and the cover member, the distribution guide configured to distribute the airflow containing dust to the first and second air inlets.

11. The dust separating apparatus of claim 1, further comprising a distribution unit connected to the cyclone, the distribution unit including a first inlet passage to direct the airflow containing dust toward the first air inlet and a second inlet passage to direct the airflow containing dust toward the second air inlet.

12. The dust separating apparatus of claim 11, wherein the distribution unit includes an inlet through which air and dust is suctioned, and the first and second inlet passages are formed at opposite sides of the inlet.

13. The dust separating apparatus of claim 11, wherein the distribution unit is formed integral with the cyclone.

14. A dust separating apparatus for a vacuum cleaner, the dust separating apparatus comprising:

a cyclone configured to provide a plurality of cyclone airflows therein, the cyclone having a first air inlet configured to receive an airflow containing dust, a first air outlet, a second air outlet, a dust outlet configured to discharge dust separated by the plurality of cyclone airflows, an opening, and a cover member for covering the opening; and a dust container to collect dust discharged from the dust outlet, wherein the cyclone includes a body configured to generate the cyclone airflows and a pair of sides, each side constituting opposite sides of the body, wherein the dust outlet and opening are formed at the body, wherein opening the cover member exposes an interior of the cyclone without exposing an interior of the dust container, and wherein the pair of sides includes a first side and a second side, the first air inlet being formed on the first side and the second air outlet being formed on the second side.

15. The dust separating apparatus of claim 14, further comprising a first filter unit detachably connected to the cyclone to filter air, wherein at least a portion of the first filter unit is inserted through the first air outlet.

16. The dust separating apparatus of claim 14, wherein the cover member includes an inner periphery formed to correspond to the shape of the body.

17. The dust separating apparatus of claim 16, further comprising a distribution unit connected to the cyclone, the distribution unit including a first inlet passage to direct the airflow containing dust toward the first air inlet, wherein the cover member opens and closes the distribution unit.

18. The dust separating apparatus of claim 17, wherein the cyclone includes a second air inlet to receive the airflow containing dust, and wherein the distribution unit includes a second inlet passage to direct the airflow containing dust toward the second air inlet.

19. A dust separating apparatus for a vacuum cleaner, the dust separating apparatus comprising:

a cyclone configured to provide a plurality of cyclone airflows therein, the cyclone having a body having a pair of sides, the body being configured to generate cyclone airflows, and the body having a dust outlet configured to discharge dust separated by the plurality of cyclone airflows; and a dust container to collect dust discharged through the dust outlet, wherein the pair of sides includes a first side and a second side opposite the first side, a first air inlet and a first air outlet are formed on the first side, and a second air inlet and a second air outlet are formed on the second side, and wherein each of the cyclone airflows moves the dust in mutually convergent directions toward the dust outlet.

20. The dust separating apparatus of claim 19, wherein the cyclone is provided with a plurality of guide members therein, for guiding the movement of the cyclone airflows.

21. A dust separating apparatus for a vacuum cleaner, the dust separating apparatus comprising:

a cyclone configured to provide a plurality of cyclone airflows therein, the cyclone having a first air inlet and a second air inlet configured to receive an airflow containing dust, a first air outlet located at a first side of the cyclone, a second air outlet located at a second side of the cyclone opposite the first side, and a dust outlet configured to discharge dust separated by the plurality of cyclone airflows;

a first filter unit connected to the cyclone to filter air, at least a portion of the first filter unit being inserted into the cyclone through the first air outlet from an outside of the cyclone;

a second filter unit connected to the cyclone to filter air, at least a portion of the second filter unit being inserted into the cyclone through the second air outlet from the outside of the cyclone;

a suctioning guide that guides the flow of air including dust toward the dust separator;

a distribution unit that distributes the air in the suctioning guide to the plurality of air inlets of the cyclone; and a dust container to collect dust discharged from the dust outlet, wherein the distribution unit includes a plurality of branch passages that guide air in the suctioning guide to the plurality of air inlets, respectively.

22. The dust separating apparatus of claim 21, wherein the distribution unit includes an inlet through which air and dust is suctioned, and the plurality of branch passages are formed at opposite sides of the inlet.

23. A dust separating apparatus for a vacuum cleaner, the dust separating apparatus comprising:

a cyclone configured to provide a plurality of cyclone airflows therein, the cyclone having a first air inlet and a second air inlet configured to receive an airflow containing dust, and a dust outlet configured to discharge dust separated by the plurality of cyclone airflows;

a suctioning guide that guides the flow of air including dust toward the dust separator;

a distribution unit that distributes the air in the suctioning guide to the plurality of air inlets of the cyclone, the distribution unit and the cyclone being formed as one body;

a cover that opens and closes at least a portion of the cyclone and at least portion of the distribution unit simultaneously; and a dust container to collect dust discharged through the dust outlet, wherein each of the cyclone airflows moves the dust in mutually convergent directions toward the dust outlet, and wherein the distribution unit includes a first inlet passage to direct the airflow containing dust toward the first air inlet and a second inlet passage to direct the airflow containing dust toward the second air inlet.

* * * * *